US005601071A

United States Patent [19]

Carr et al.

[11] Patent Number: 5,601,071

[45] Date of Patent: Feb. 11, 1997

[54] FLOW CONTROL SYSTEM

[75] Inventors: Larry L. Carr, Chesterland; Dennis S. Mizerak, Brunswick, both of Ohio

[73] Assignee: Tridelta Industries, Inc., Mentor, Ohio

[21] Appl. No.: 378,481

[22] Filed: Jan. 26, 1995

[51] Int. Cl.[6] ..... F24H 3/00

[52] U.S. Cl. ..... 126/116 A; 126/110 R; 431/20; 73/722; 73/716

[58] Field of Search ..... 73/722, 716; 126/116 A, 126/110 R; 431/20

[56] References Cited

U.S. PATENT DOCUMENTS

| | | | |
|---|---|---|---|
| 2,978,634 | 4/1961 | Arps | 324/1 |
| 3,153,935 | 10/1964 | Karlson | 73/398 |
| 3,158,029 | 11/1964 | Fischer | 73/407 |
| 3,162,795 | 12/1964 | Cherniak | 318/32 |
| 3,296,868 | 1/1967 | Koppel et al. | 73/407 |
| 3,324,927 | 6/1967 | Staring | 431/15 |
| 3,964,675 | 6/1976 | Euchner, Jr. | 236/15 C |
| 3,983,930 | 10/1976 | Franz | 165/31 |
| 4,175,398 | 11/1979 | Edwards et al. | 62/172 |
| 4,192,641 | 3/1980 | Nakagawa et al. | 431/15 |
| 4,251,025 | 2/1981 | Bonne et al. | 236/14 |
| 4,340,355 | 7/1982 | Nelson et al. | 431/20 |
| 4,467,998 | 8/1984 | Spence | 251/58 |
| 4,648,551 | 3/1987 | Thompson et al. | 236/49 |
| 4,663,589 | 5/1987 | Fiori, Jr. | 324/208 |
| 4,671,116 | 6/1987 | Glennon et al. | 73/728 |
| 4,677,357 | 6/1987 | Spence et al. | 318/335 |
| 4,688,547 | 8/1987 | Ballard et al. | 126/116 A |
| 4,703,747 | 11/1987 | Thompson et al. | 126/112 |
| 4,706,553 | 11/1987 | Sharp et al. | 98/115.3 |
| 4,706,881 | 11/1987 | Ballard | 236/15 BD |
| 4,729,207 | 3/1988 | Dempsey et al. | 126/112 |
| 4,777,436 | 10/1988 | Fiori, Jr. | 324/208 |
| 4,779,577 | 10/1988 | Ritter et al. | 123/41.05 |
| 4,784,580 | 11/1988 | Takata et al. | 417/295 |
| 4,788,867 | 12/1988 | Kishel | 73/722 |
| 4,789,330 | 12/1988 | Ballard et al. | 431/75 |
| 4,792,089 | 12/1988 | Ballard | 236/11 |
| 4,795,088 | 1/1989 | Kobayashi et al. | 236/49 |
| 4,811,897 | 3/1989 | Kobayashi et al. | 236/49 |
| 4,841,245 | 6/1989 | Fiori, Jr. | 324/208 |
| 4,851,770 | 7/1989 | Fiori, Jr. | 324/208 |
| 4,860,231 | 8/1989 | Ballard et al. | 364/571.01 |
| 4,894,999 | 1/1990 | Kaiju et al. | 62/158 |
| 4,899,549 | 2/1990 | Berge et al. | 62/160 |
| 4,948,040 | 8/1990 | Kobayashi et al. | 236/49.3 |
| 4,959,970 | 10/1990 | Meckler | 62/176.1 |
| 4,966,849 | 3/1991 | Burst et al. | 62/133 |
| 5,022,232 | 6/1991 | Sakamoto et al. | 62/133 |
| 5,023,973 | 6/1991 | Tsuchida et al. | 15/319 |
| 5,027,789 | 7/1991 | Lynch | 126/116 A |
| 5,050,389 | 9/1991 | Wigmore et al. | 62/84 |
| 5,074,780 | 12/1991 | Erdman | 431/24 |
| 5,117,646 | 6/1992 | Nose et al. | 62/181 |
| 5,131,238 | 7/1992 | Meckler | 62/271 |
| 5,166,468 | 11/1992 | Atkeson | 102/207 |
| 5,197,667 | 3/1993 | Bowsky et al. | 236/49.3 |
| 5,331,944 | 7/1944 | Kujawa et al. | 126/110 R |

*Primary Examiner*—Carroll B. Dority

*Attorney, Agent, or Firm*—D. Peter Hochberg; Mark Kusner; Michael Jaffe

[57] ABSTRACT

A control system for regulating a flow rate of a heat transfer fluid in a heat transfer system, the heat transfer system having a heat transfer fluid flow path, flow control device for creating flow along the path, a fuel source for providing a combustible fuel to the path, an air source for providing combustion air to the path, and an assembly for combusting the fuel and air, the control system comprising a sensor for sensing a measured flow value at the air source, a controller for storing an optimum flow value at the air source and for storing a range of operating control values for the flow control device, the operating control values corresponding to the optimum flow value, a system for calculating a deviation between the measured flow value and the optimum flow value, and a system for varying the operation of the flow control means in accordance with deviation.

52 Claims, 20 Drawing Sheets

THERMOSTAT
11

40
ALARM
PROCESS CONTROL
38
EXHAUST
CIRCULATING BLOWER CONTROL
MOTOR SPEED CONTROL
20
34
36
M
10
FUEL SUPPLY
46
25
18
13
16
50
SC
SECONDARY VALVE
L
BURNER
24
19
PR
27
H
PRIMARY VALVE
PI
17
23
44
14
PILOT VALVE
32
15
AIR INTAKE
IGNITOR
21
FLAME DETECT
27

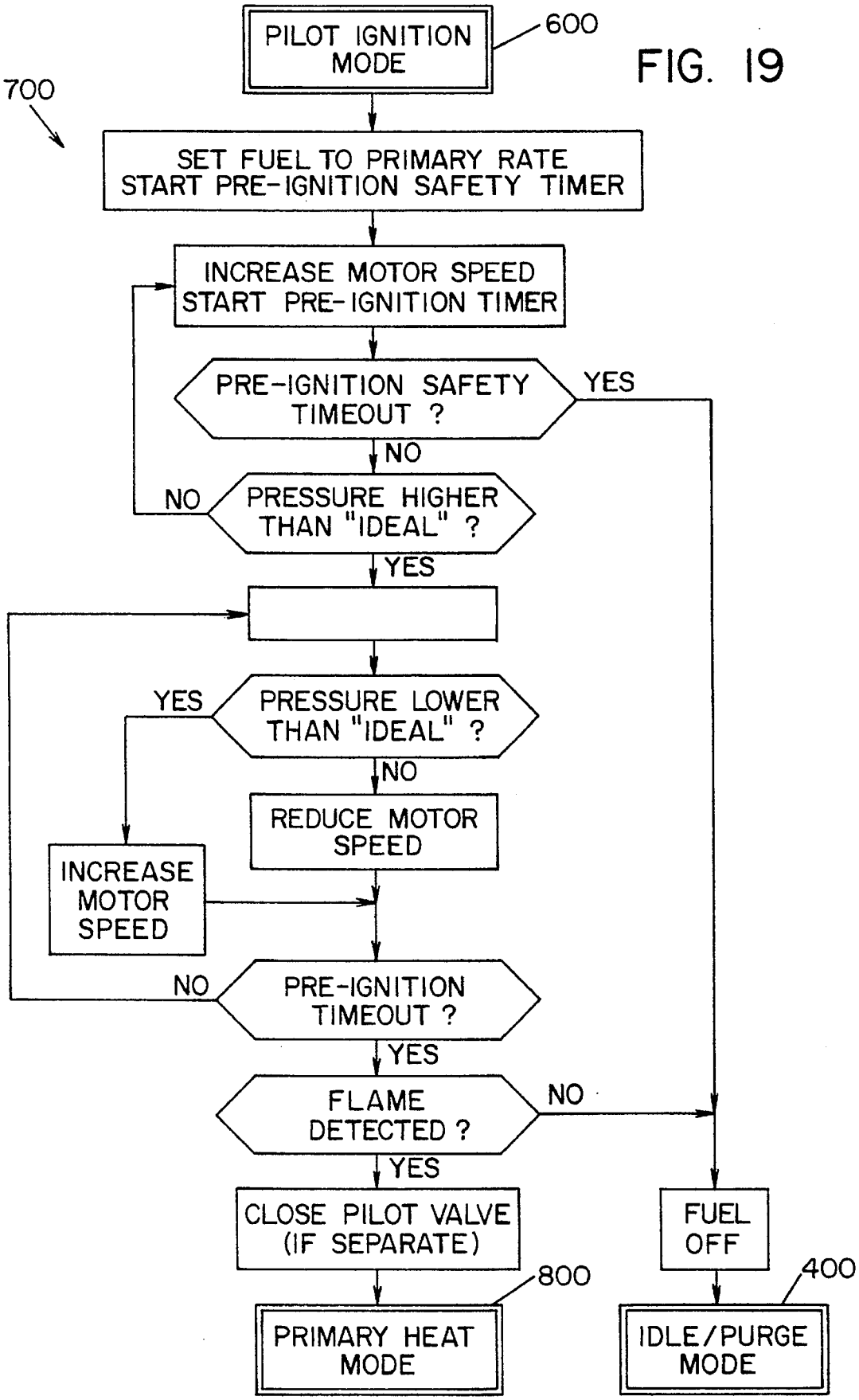
PILOT IGNITION MODE
600
FIG. 19
700
SET FUEL TO PRIMARY RATE
START PRE-IGNITION SAFETY TIMER
INCREASE MOTOR SPEED
START PRE-IGNITION TIMER
PRE-IGNITION SAFETY TIMEOUT ?
YES
NO
NO
PRESSURE HIGHER THAN "IDEAL" ?
YES
YES
PRESSURE LOWER THAN "IDEAL" ?
NO
REDUCE MOTOR SPEED
INCREASE MOTOR SPEED
NO
PRE-IGNITION TIMEOUT ?
YES
FLAME DETECTED ?
NO
YES
CLOSE PILOT VALVE (IF SEPARATE)
FUEL OFF
800
400
PRIMARY HEAT MODE
IDLE/PURGE MODE

FLOW CONTROL SYSTEM

FIELD OF INVENTION

The present invention relates generally to flow control systems, and more particularly, to a system for controlling fluid flow in a flow sensitive system such as a fuel combustion system, a cooling/defrost system or the like. The present invention finds advantageous application in controlling excess air in a gas furnace having a variable speed inducer motor and will be described with particular reference thereto, although it would be appreciated that the present invention has other broader applications and may be used in cooling systems and any other flow responsive systems.

BACKGROUND OF THE INVENTION

In recent years, forced or induced combustion furnace systems have become standard in residential use as a result of legislated minimum efficiency requirements. Minimum efficiency requirements, together with the desire to conserve energy, has led to the development of higher efficiency furnaces. It is generally known that in the operation of a gas fired furnace, combustion efficiency can be optimized by maintaining a specific ratio of fuel input flow rate and combustion air flow rate. Generally, the ideal ratio is offset somewhat for safety purposes by providing slightly more combustion air (conventionally referred to as "excess air") than that normally required for optimum combustion efficiency. Too much excess air, however, can result in furnace heat loss. It is therefore desirable to control excess air to minimize heat loss. It is known that the flow of combustion gases through the furnace's heat exchanger produces a pressure drop across the heat exchanger and that the pressure drop across the furnace's heat exchanger is proportional to total flow. Therefore, maintaining a desired flow, i.e., pressure drop, across the heat exchanger is critical to maintain a desired level of excess air for a given fuel flow rate.

Numerous factors, however, affect the critical nature of pressures and flows through a heat exchanger. Clearly, the basic design of a heat exchanger establishes its basic operating characteristics. A furnace's installation and setup, however, also have an impact on the pressure drop across the heat exchanger. For instance, factors such as the size and length of an exhaust pipe, as well as its configuration (i.e., number of elbows) can affect flow through the heat exchanger. Further, environmental conditions, such as altitude and temperature (which affect atmospheric pressure), even under pressure in a vent system, affect the flow and pressure through a heat exchanger. Still further, operating conditions such as dust build-up on an inducer fan, voltage variations on the power line or even bearing problems can affect the operation of the inducer blower and thus the pressure drop across a heat exchanger. Each of the foregoing create design and installation problems in maintaining a desired air flow through the heat exchanger.

Control systems have been suggested which would vary the speed of an inducer blower based upon sensed changes in the pressure drop across a heat exchanger. To date, however, such systems have not proved satisfactory in the marketplace based primarily upon the cost and reliability of sensors which can monitor pressure levels at desired locations in the heat exchanger. In this respect, the operative parts of a sensor are exposed to and must operate in an environment of corrosive combustion gases.

Another problem related to the use of pressure sensors in furnace applications is that the accuracy of such sensors is in many instances affected by the ambient "noise" or "vibration" typically associated with furnace operation. In this respect, pressure sensors typically include a movable diaphragm having sensing means attached thereto. Vibration noise created by the blower and inducer motor, or even by the rapid flexing of metal panels upon ignition of a burner, can produce movement of the diaphragm. (i.e., "flutter") which in turn affects the accuracy of the sensor signal.

The present invention overcomes these and other problems and provides a flow control system for regulating flow of a heat transfer fluid in a heat transfer system, such as a fuel combustion system, in response to sensed pressure differentials or flow at predetermined locations within such systems. In addition, the present invention provides a sensor which is less sensitive to vibration noise, yet is reliable, accurate and relatively inexpensive to manufacture.

SUMMARY OF THE INVENTION

In accordance with the present invention there is provided a differential pressure sensor comprised of a housing having first and second spaced apart fluid chambers connectable respectively to first and second fluid pressure sources to be monitored. A pressure responsive assembly is disposed within the housing and is comprised of first and second pressure sensitive members connected to one another. The first pressure sensitive member is exposed to the first fluid chamber and the second pressure sensitive member is exposed to the second chamber. The pressure responsive assembly is mounted to the housing wherein the assembly is movable along a fixed axis in response to differences in fluid pressure between the first and the second chambers. A electrically conductive element is attached to the pressure responsive assembly for movement therewith. The electrically conductive element is disposed between the first and the second pressure sensitive elements and external to the first and the second chambers. A non-contacting sensor is positioned adjacent to the electrically conductive element. The sensor is responsive to movement of the electrically Conductive element and provides electrical signals indicating the position of the electrically conductive element.

In accordance with another aspect of the present invention there is provided a differential pressure transducer comprising a central housing section and a first cap and a second cap fastened to the housing section to define a generally cylindrical housing. A pair of generally identical pressure responsive members are mounted within the housing. Each pressure responsive member includes a rigid circular diaphragm plate having a centrally located pin which extends to one side of the plate along the axis thereof. An annular diaphragm element of resilient material is molded to the outer edge of the diaphragm plate. The diaphragm element includes a seal portion formed along the outer periphery thereof. These pressure responsive members are mounted within said housing wherein the pins on the diaphragm plate are coaxially aligned and extend toward each other. A first fluid chamber is defined between one of the pressure responsive members and the first cap, and a second pressure chamber is defined between the other pressure responsive member and the second cap. Each fluid chamber includes an inlet port communicating therewith which is adapted for connection to a fluid signal to be monitored. An electrically conductive element is mounted to the pins on the pressure responsive member for movement therewith. A resonant circuit including coils surrounding the electrically conductive element is provided and includes oscillator means operative to cause resonance of a circuit means and means operative upon connection of the circuit means to an electrical power source to provide an electrical signal indicative of the position of the pressure responsive members.

In accordance with another aspect of the present invention there is provided a controller for regulating a combustion flow rate along a path in a combustion system having a heat exchanger and a variable speed inducer, said controller comprising means for establishing a plurality of operating modes, means for storing a predetermined optimum pressure differential value for each of the operating modes, sensing means for measuring a pressure differential between two locations along the path, calculation means for calculating a deviation between the measured pressure differential and the predetermined optimum pressure differential value, and means for varying the velocity of the variable speed inducer in accordance with the deviation.

In accordance with another aspect of the present invention there is provided a method of operating a combustion heating system having a heat exchanger, a variable speed inducer for creating flow along a path including the heat exchanger, and a transducer for measuring a pressure differential along the path. The method of operating the system comprises the steps of establishing a plurality of system operating modes, each of the system operating modes having a predetermined optimum pressure differential value, sensing a measured pressure differential value along the path, computing a deviation between the measured pressure differential value and the predetermined optimum pressure differential value, and varying the velocity of the variable speed inducer in accordance with the deviation.

In accordance with another aspect of the present invention there is provided a control system for regulating a flow rate of a heat transfer fluid in a heat transfer system, the heat transfer system having a heat transfer fluid flow path, flow control means for creating flow along the path, a fuel source for providing a combustible fuel to the path, an air source for providing combustion air to the path, and means for combusting the fuel and air to create the heat transfer fluid. The control system comprises means for storing a fuel flow value and a corresponding air flow value for a plurality of heat transfer values, first sensing means for measuring a flow value at the fuel source, second sensing means for measuring a flow value at the air source, comparison means for comparing the stored fuel flow value to the measured fuel flow value at the fuel source, and for comparing the stored air flow value to the measured air flow value at the air source, fuel regulating means for regulating the fuel flow at the fuel source, and means for adjusting the fuel regulating means and the flow control means in response to the comparison means.

In accordance with another aspect of the present invention there is provided a control system for regulating a flow rate of heat transfer fluid in a heat transfer system, the heat transfer system having a heat transfer fluid flow path, flow control means for creating flow along the path, a fuel source for providing a combustible fuel to the path, and an air source for providing combustion air to the path. The control system comprises sensing means for measuring a flow value at the air source, means for storing an optimum flow value at the air source, means for storing a range of operating control values for the flow control means, the operating control values corresponding to the optimum flow value, calculation means for calculating a deviation between the measured flow value and the optimum flow value, and means for varying the operation of the flow control means in accordance with the deviation, including means for limiting operation of the flow control means to the range of operating control values.

It is an object of the present invention to provide a system for controlling fluid flow in a flow responsive system.

It is another object of the present invention to provide a system as described above for regulating a flow rate of heat transfer fluid in a heat transfer system.

It is another object of the present invention to provide a system as described above for controlling combustion air flow to a fuel combustion system.

It is another object of the present invention to provide a system as described above for controlling excess air in a gas fired furnace.

Another object of the present invention is to provide a furnace control system and having a variable speed inducer, a sensing device to monitor pressure drop across a heat exchanger, and furnace control means for varying the speed of the inducer in response to sensed variations in the pressure drop across the heat exchanger.

A still further object of the present invention is to provide a furnace control system as described above, having a plurality of operating modes, each mode having ideal operating parameters.

Another object of the present invention is to provide a sensor for sensing and detecting differential pressure between two fluid sources.

A still further object of the present invention is to provide a sensor as described above which provides a continuous electrical output representative of the detected differential pressure.

Another object of the present invention is to provide a sensor as described above which may have a digital or analog output.

Another object of the present invention is to provide a sensor as described above including an offset to either digital or analog outputs (or both) at zero differential.

Another object of the present invention is to provide a sensor as described above including means for varying the slope (i.e., full scale output) of either the digital output or the analog output.

Another object of the present invention is to provide a sensor as described above including means for providing a square root value for the digital output, the analog output or both.

Another object of the present invention is to provide a sensor as described above including a dedicated display for displaying output information in engineering units.

A still further object of the present invention is to provide a sensor as described above which is less susceptible to noise and vibration than sensors known heretofore.

These and other objects and advantages will become apparent from the following description of a preferred embodiment of the present invention taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part thereof and wherein:

FIG. 19 is a flow diagram of the operation of a Primary Ignition Mode of the present invention;

BRIEF DESCRIPTION OF THE PREFERRED EMBODIMENT

Figure 1:
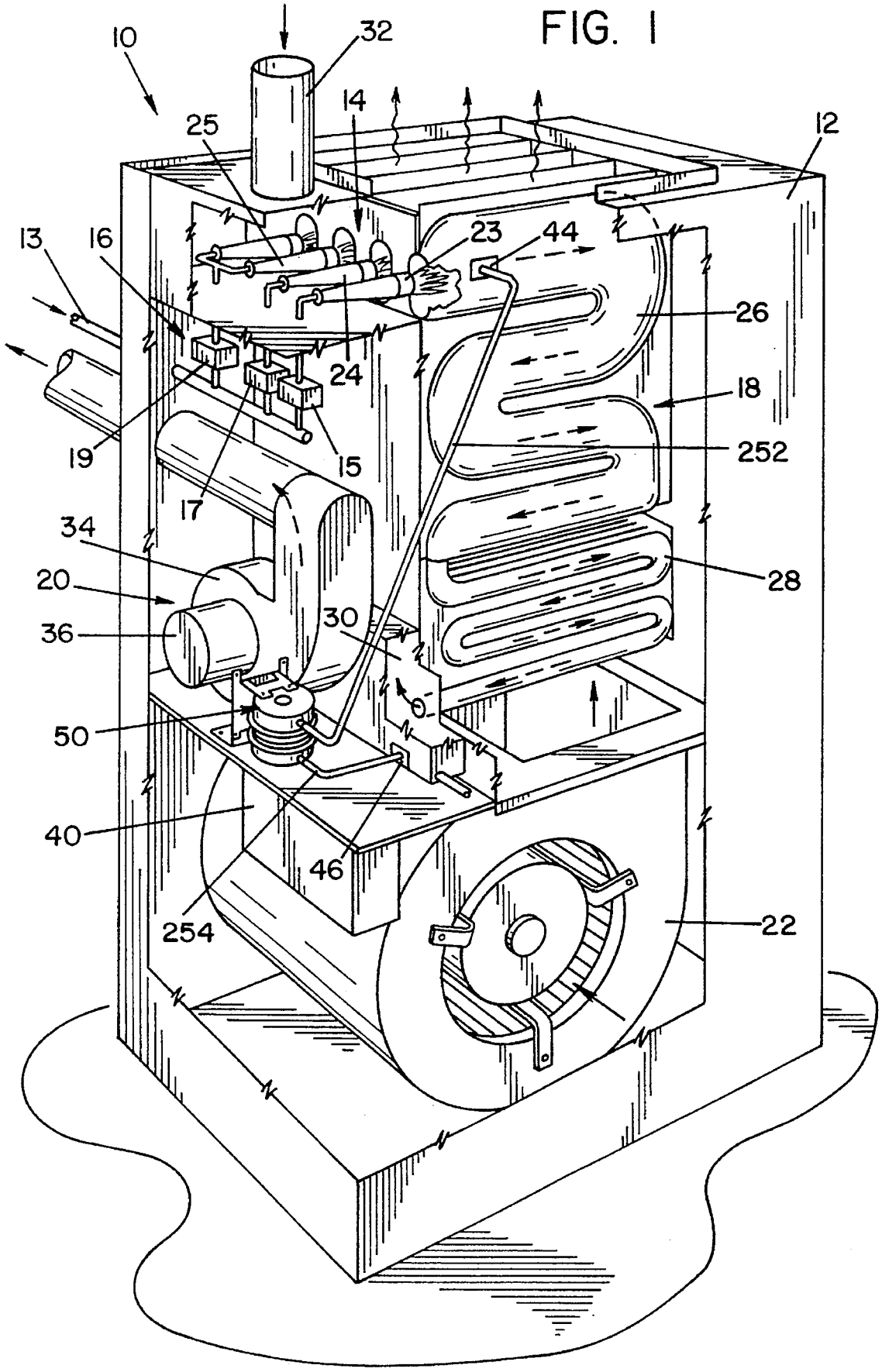
FIG. 1 is a perspective view of a conventional gas furnace.

Referring now to the drawings wherein the showing is for the purpose of illustrating preferred embodiments of the invention only, and not for the purpose of limiting same, the present invention relates to a system for regulating and controlling fluid flow along a path in response to pressure variations along the path. The present invention is particularly applicable for use in a heat transfer system, such as a conventional gas fired furnace 10 as shown in FIG. 1, and will be described with particular reference thereto. It will be appreciated, however, after a further reading of this specification, that the present invention has other, broader applications.

Furnace 10 would typically include a thermostat 11, a rectangular housing containing therein a burner assembly 14, a gas regulator 16, a heat exchanger assembly 18, an inducer assembly 20, and a circulating air blower 22. Furnace 10 and its components in and of itself form no part of the present invention and therefore shall not be described in great detail.

Figure 2:
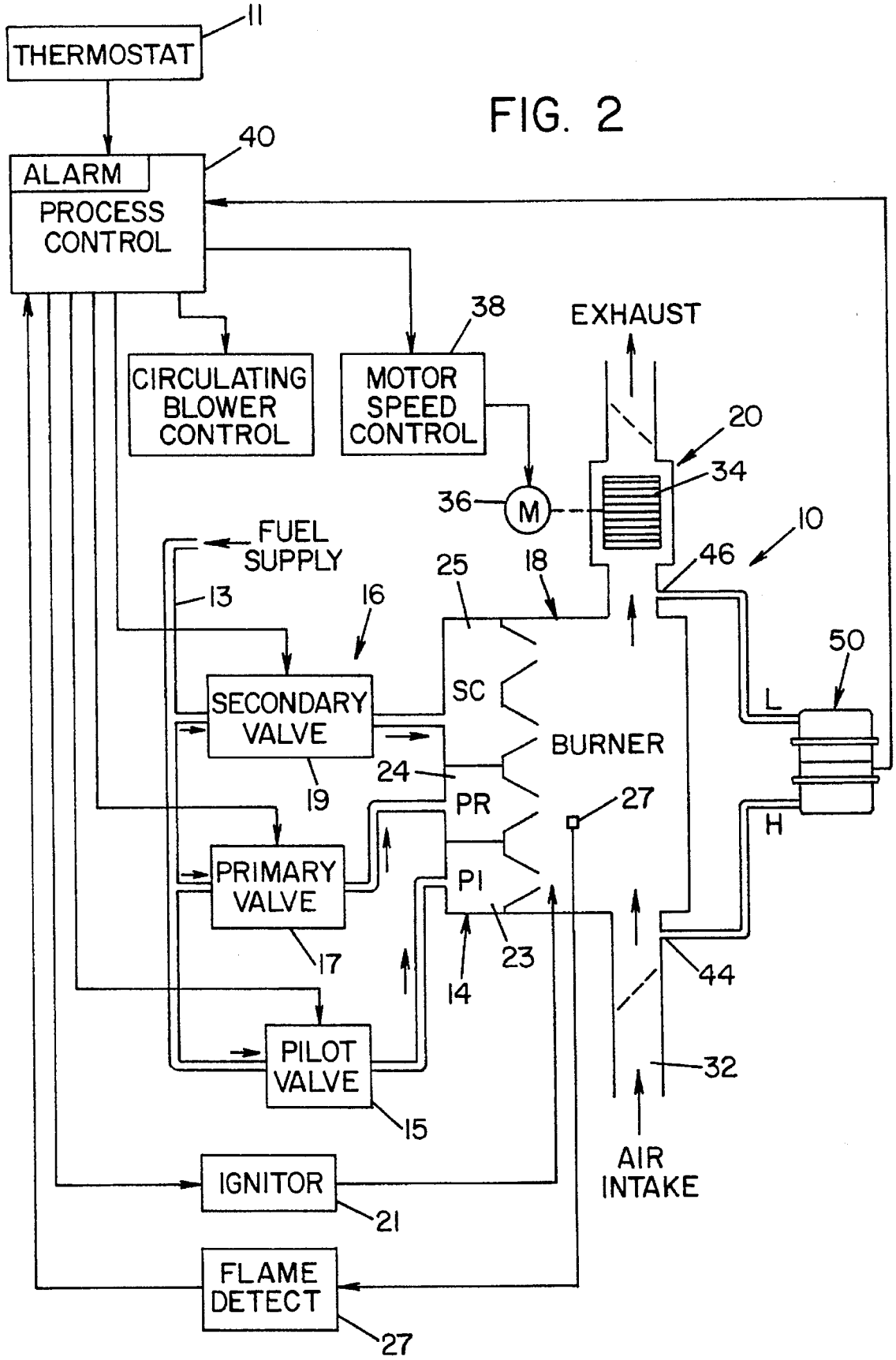
FIG. 2 is a schematic representation of a furnace control system according to the present invention.

In the embodiment shown, burner assembly 14 includes a pilot 23 a set of primary burners 24, and a set of secondary burners 25. Pilot 23 and burners 24, receive combustion gas from fuel line 13 via gas regulator 16. Regulator 16 preferably includes a pilot valve 15, a primary valve 17 and a secondary valve 19 (schematically illustrated in FIG. 2) which respectively regulate fuel to pilot 23, primary burners 24 and secondary burners 25. An ignitor 21, which is schematically shown in FIG. 2, is provided for electronic ignition of pilot 23 and burners 24, 25. With the electronic ignition, a flame detect sensor 27 is provided, as schematically illustrated in FIG. 2. Burners 24 and 25 are arranged to inject the fuel gas into a primary heat exchanger 26. A secondary heat exchanger 28 is operatively connected at its leading end to primary heat exchanger and at its trailing end to a collector box 30. Air is drawn into the heat exchanger assembly through an air inlet 32 so that the fuel gas and air mixture may be combusted therein. Specifically, combustion air is drawn into the heat exchanger assembly 18 by means of inducer assembly 20. Inducer assembly 20 is generally comprised of an inducer fan or wheel 34 which is driven by an inducer motor 36 which includes a motor speed controller 38.

According to the present invention, inducer motor 36 is a variable speed motor, and preferably a switched reluctance (SR) motor. In this respect, while other types of variable speed motors such as an electronically commutated permanent magnet motor (ECM) find advantageous application to the control system described herein, certain properties and operating characteristics of an SR motor lend themselves to a control system according to the present invention. Specifically, SR motors are more efficient than alternative types of motors, having current density higher than permanent magnet motors. SR motors are exceptionally robust, small in size and are well suited to the hazardous environment that may be found in a furnace application. In addition, SR motors have the lowest manufacturing costs of any motor, and their low inertia allows higher acceleration and deceleration than alternative types of motors. The magnetic properties of permanent magnet motors degrade more at high temperatures than do the ferro-magnetic properties of SR motors. All these advantages make an SR motor the most desirable motor in furnace applications. A furnace controller 40 is provided to control the general operations of furnace 10 in response to inputs received from thermostat 11, flame detector 27 and sensor 50. Sensor 50 is provided to sense differential pressures which exist across heat exchanger assembly 18, and to provide a continuous electrical signal indicative of the instantaneous pressure differential at locations across heat exchanger assembly 18. To this end, taps 44, 46 are provided at the inlet and outlet positions of heat exchanger assembly 18 and provide two fluid pressure levels to be monitored.

A system according to the present invention is schematically illustrated in FIG. 2. Importantly, according to the present invention, controller 40 includes a microprocessor programmed to operate furnace 10 in a plurality of operating modes, wherein each operating mode has specific, desired operating parameters relating to fluid flow through the system, inducer motor 36 speeds, etc., stored in memory. Utilizing the continuous signal output of sensor 50, the microprocessor of controller 40 monitors and regulates the mode of operation of furnace 10 to optimize the performance thereof based upon the desired operating parameters stored in its memory.

More specifically, in the embodiment shown, controller 40 utilizes the continuous signal output of sensor 50,which signal is indicative of a flow rate, i.e., a pressure differential at select locations in the system, and regulates the speed of inducer motor 36 in response to the deviation between the pressure differential sensed by sensor 50 and the desired operating parameter stored in memory.

THE SENSOR

Figure 3:
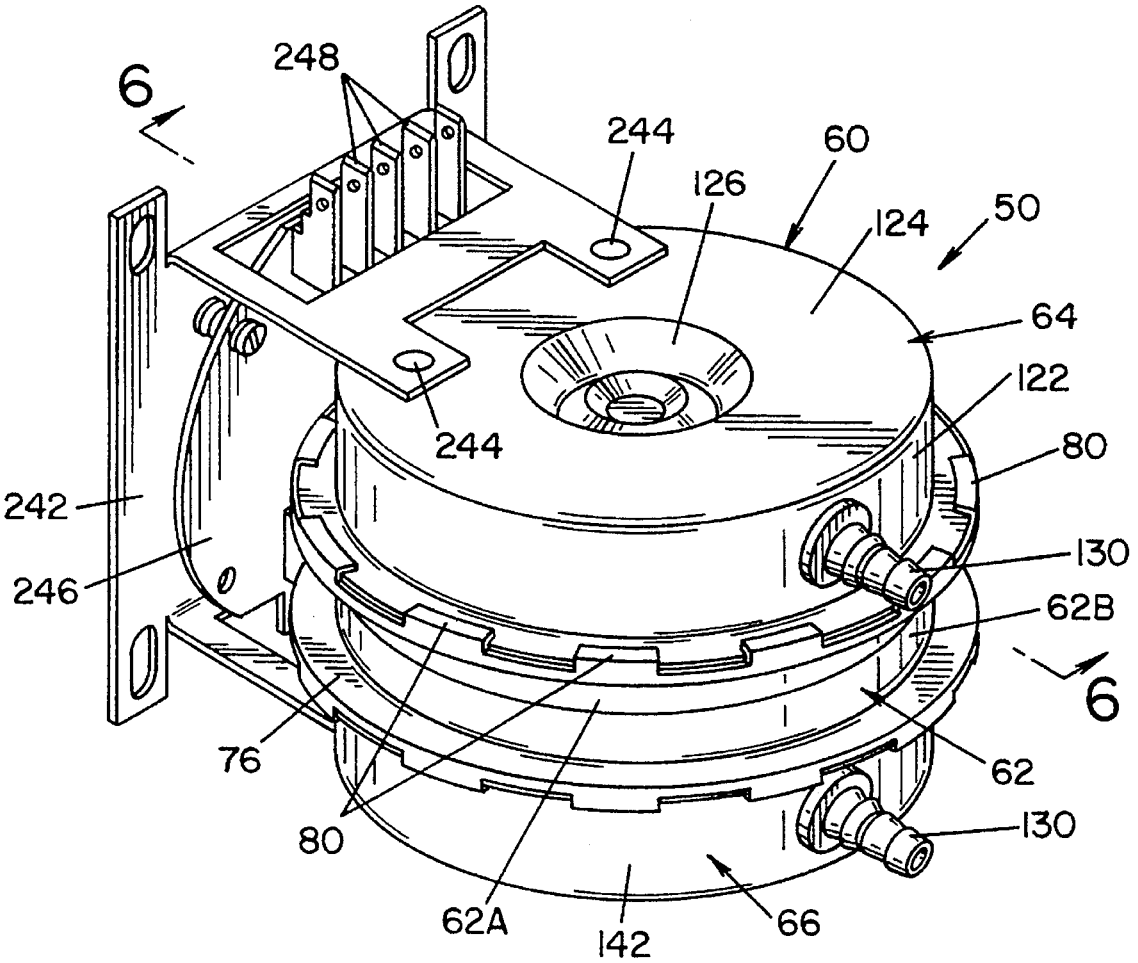
FIG. 3 is a perspective view of a pressure sensor illustrating a preferred embodiment of another aspect of the present invention.
Figure 4:
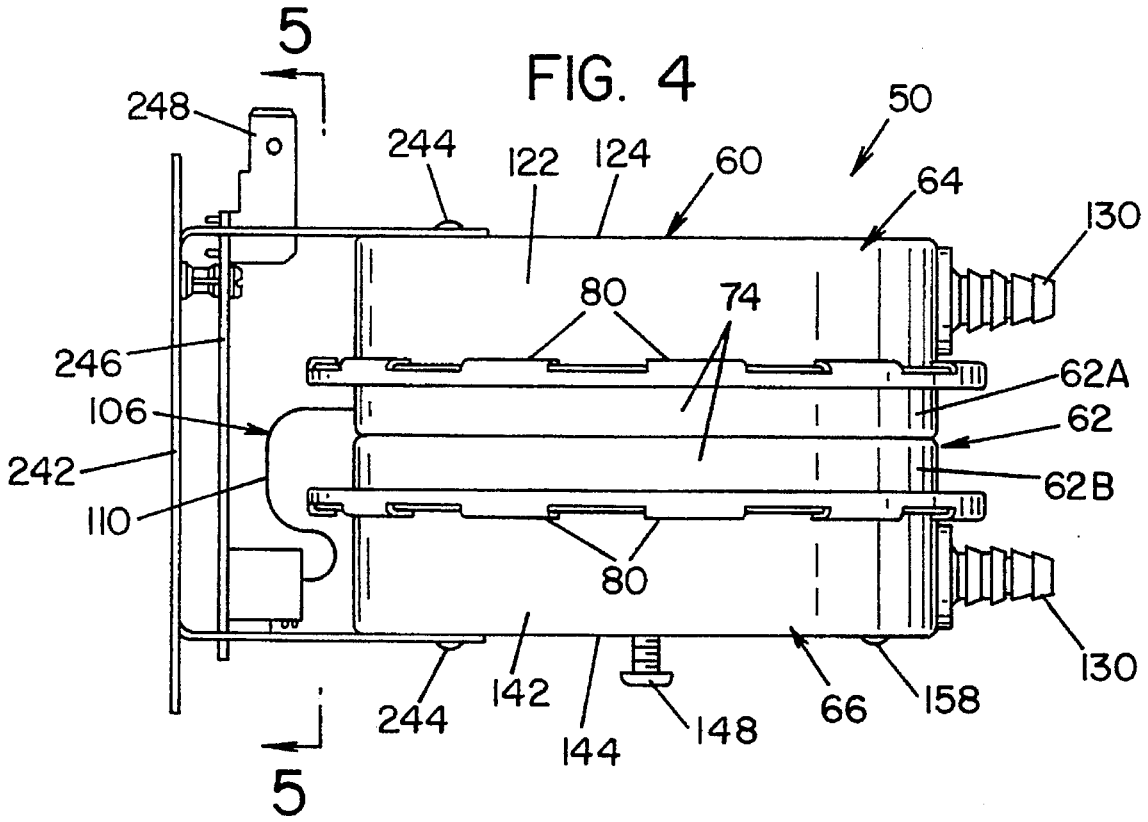
FIG. 4 is a side elevational view of the pressure sensor shown in FIG. 3.
Figure 5:
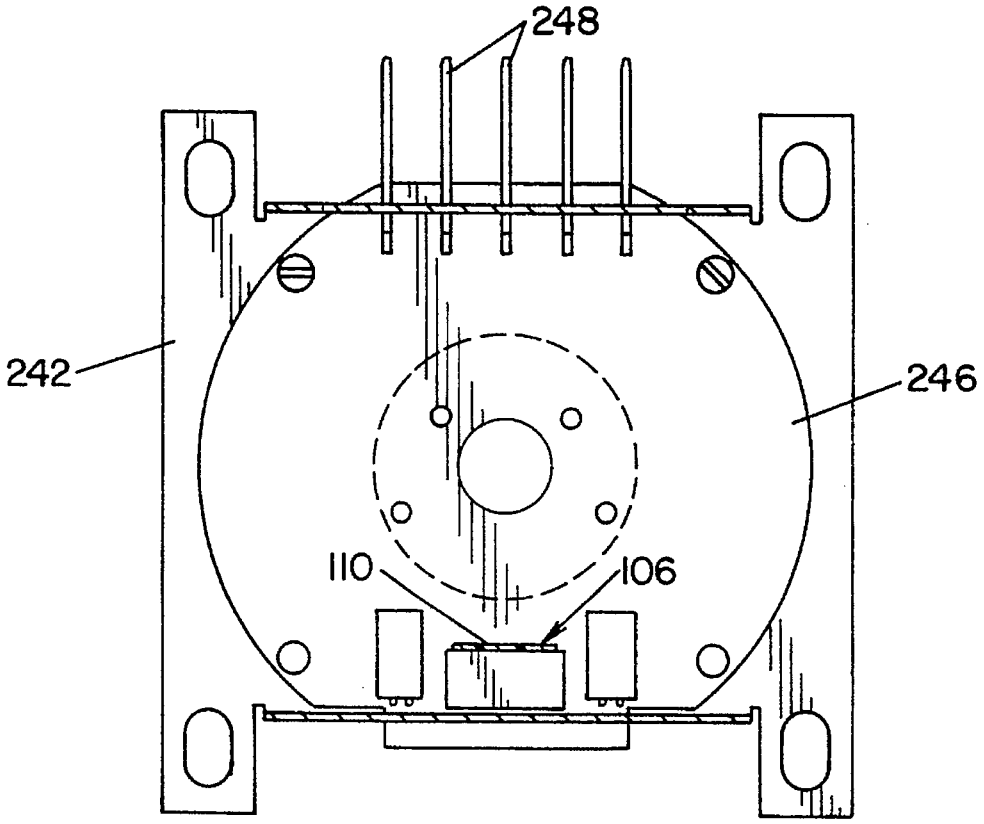
FIG. 5 is a view taken along lines 5—5 of FIG. 4.

Referring now to FIG. 3, sensor 50 is best illustrated. Sensor 50 includes a body assembly 60, which in the embodiment shown, is generally cylindrical in shape. Body assembly 60 is basically comprised of a central housing 62, and a top cap 64 and a bottom cap 66 which are dimensioned for attachment thereto.

Figure 6:
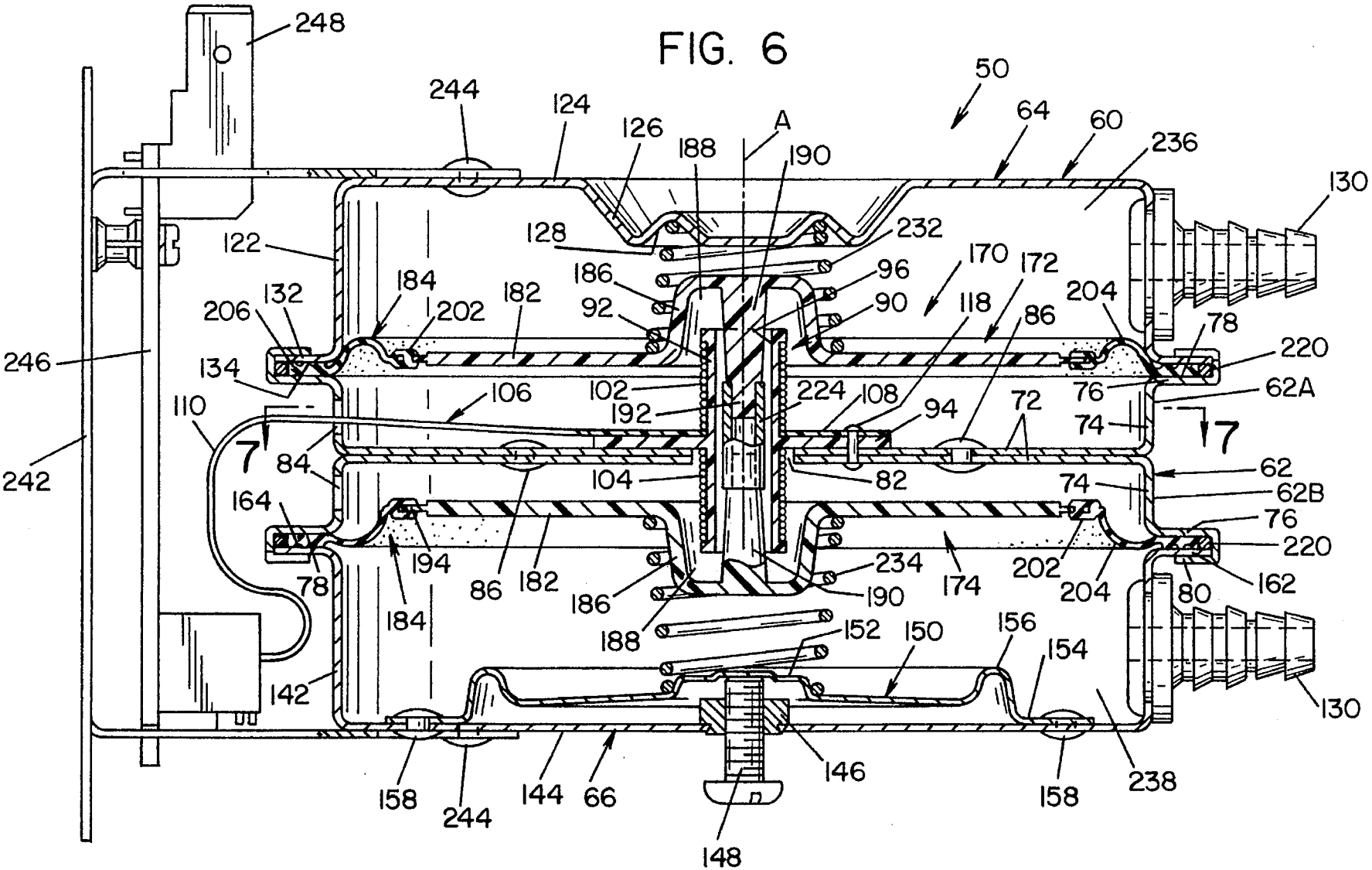
FIG. 6 is an enlarged sectional view taken along lines 6—6 of FIG. 3.
Figure 7:
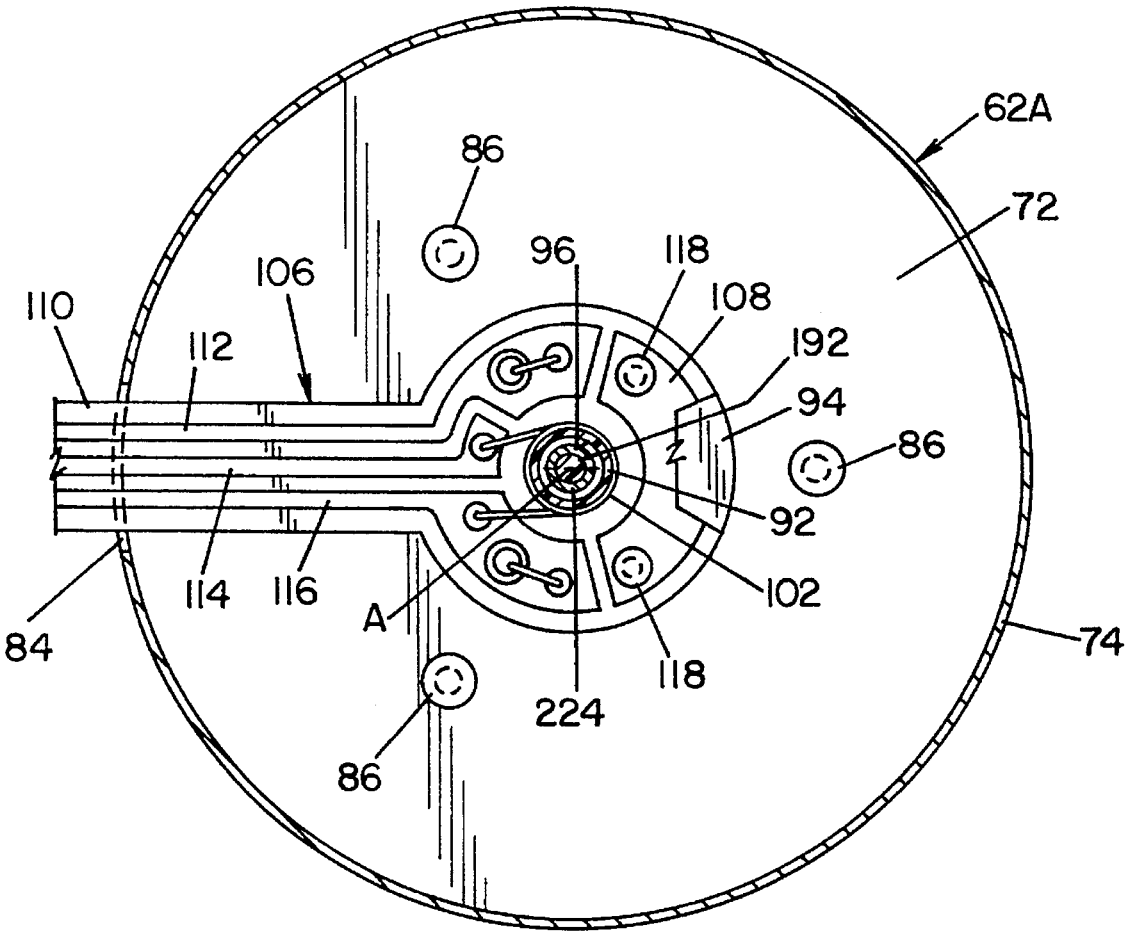
FIG. 7 is a sectional view taken along lines 7—7 of FIG. 6.

In the embodiment shown, central housing 62 is generally formed of two side-by-side identical housing sections 62A, 62B. Each housing section 62A, 62B is generally cup-shaped and includes a closed end defined by a bottom wall 72 and an open end defined by the free edge of a side wall 74. Side wall 74 is offset to include a shoulder or corner 76 which defines an annular outward facing planar surface 78. Free end or edge of side wall 74 is crenelated, i.e., is notched to define a plurality of spaced apart tabs 80. A centrally located aperture 82 is formed in bottom wall 72, and a slot 84 is formed through side wall 74, as best seen in FIG. 6. Housing sections 62A, 62B are fastened together by means of conventional fasteners or rivets 86 extending through bottom walls 72. As indicated above, in the embodiment shown, housing sections are identical components which are assembled bottom wall 72 to bottom wall 72 so as to be mirror images of each other, and to be symmetrical about a common central axis designated "A" in the drawings. Aligned apertures 82 in housing sections 62A, 62B are dimensioned to receive therethrough a coil subassembly 90, which is part of a non-contacting sensor which will be described in greater detail below. Coil subassembly 90 is generally comprised of a rigid spool 92 having a laterally extending circular flange 94 at its midpoint. Spool 92 is generally tubular in shape and defines a cylindrical passage 96. Two end-to-end coils 102, 104 are mounted to spool 92 above and below flange 94. According to the present invention, spool 92 is formed to be an electrical insulator. A flexible membrane 106 having circuit means etched thereon is mounted to flange 94 of spool 92. Membrane 106 includes a circular portion 108 and an elongated strip portion 110. Three electrical circuit paths 112, 114, 116 are provided on membrane 106. Path 112 is connected to one end of coil 104, path 114 is connected to one end of coil 102 and a path 116 is a common path which is connected to the opposite ends of coils 102, 104.

Spool 92 with membrane 106 thereon is fixedly mounted to housing sections 62A, 62B by rivets 118 so that coils 102, 104 are generally symmetrical to axis A which extends through housing sections 62A, 62B. Strip portion 110 of membrane 106, having circuit paths 112, 114, 116 thereon, is dimensioned to extend through slot 84 in housing section 62A. In the embodiment shown, coil subassembly 90 is connected to an external circuit board as will be discussed in greater detail below.

Referring now to upper cap 64 and lower cap 66, as indicated above caps 64, 66 are dimensioned to be fastened to central housing 62. Upper and lower caps 64, 66 are generally similar in that both are cylindrical in shape and generally cup shaped having a closed end and an open end for attachment to central housing 62.

More specifically, upper cap 64 includes a cylindrical side wall 122 and an end wall 124 which defines the closed end thereof. End wall 124 is formed to include an inward extending projection 126 having an inward facing annular recess 128. A conventional hose fitting 130 is mounted to side wall 122 to define a port therethrough. The free end of side wall 122 includes an outward extending flange 1.32 which defines a planar, annular surface 134. Flange 132 is dimensioned to have an outer diameter slightly less than the inner diameter of the opening defined by tabs 80 on side wall 74 of central housing section 62A. In this respect, flange 132 of upper cap 64 is received within tabs 80 of central housing 62 with annular surface 134 of upper cap 64 being aligned with and parallel to annular planar surface 78 of central housing section 62A.

Lower cap 66 is comprised of a cylindrical side wall 142 and a generally planar end wall 144 which defines the closed end of lower cap 66. End wall 144 includes a centrally positioned threaded fitting 146 which is dimensioned to receive a conventional fastener 148. An adjustment plate 150 is mounted to end wall 144 to operatively engage fastener 148. Adjustment plate is basically comprised of a strip of resilient material having a central crown portion 152 and planar end portions 154. Near end portions 154, adjustment plate 150 is formed to have a generally U-shaped deformation 156 about which adjustment plate 150 may be moved or flexed by adjuster 148. Adjustment plate 150 is mounted to end wall 144 of lower cap 66 by rivets 158. According to the present invention, adjusting plate 150 is fastened to end wall 144 in a manner which maintains the structural integrity of end wall 144. In other words, rivets 158 and adjustment plate 150 form a fluid tight seal with end wall 144. As with upper cap 64, a conventional hose fitting 130 is mounted to side wall 142 to define a port therethrough. The free end of side wall 142 includes an outward extending flange 162 which defines a planar annular surface 164. Flange 162 is dimensioned to have an outer diameter slightly less than the inner diameter of the opening defined by tabs 80 on wall of housing section 62B. In this respect, flange 162 of lower cap 66 is dimensioned to correspond to flange 132 of upper cap 64, and is likewise dimensioned to be received within tabs 80 of housing section 62B with annular surface 164 of lower cap 66 being aligned with and parallel to planar annular surface 78 of housing section 62B.

According to the present invention, a pressure responsive assembly, designated 170 in the drawings, is provided within body assembly 60. In the embodiment shown, assembly 170 is comprised of a pair of pressure sensitive members 172, 174 which are positioned respectively between upper cap 64 and central housing 62, and between lower cap 66 and central housing 62.

Figure 8:
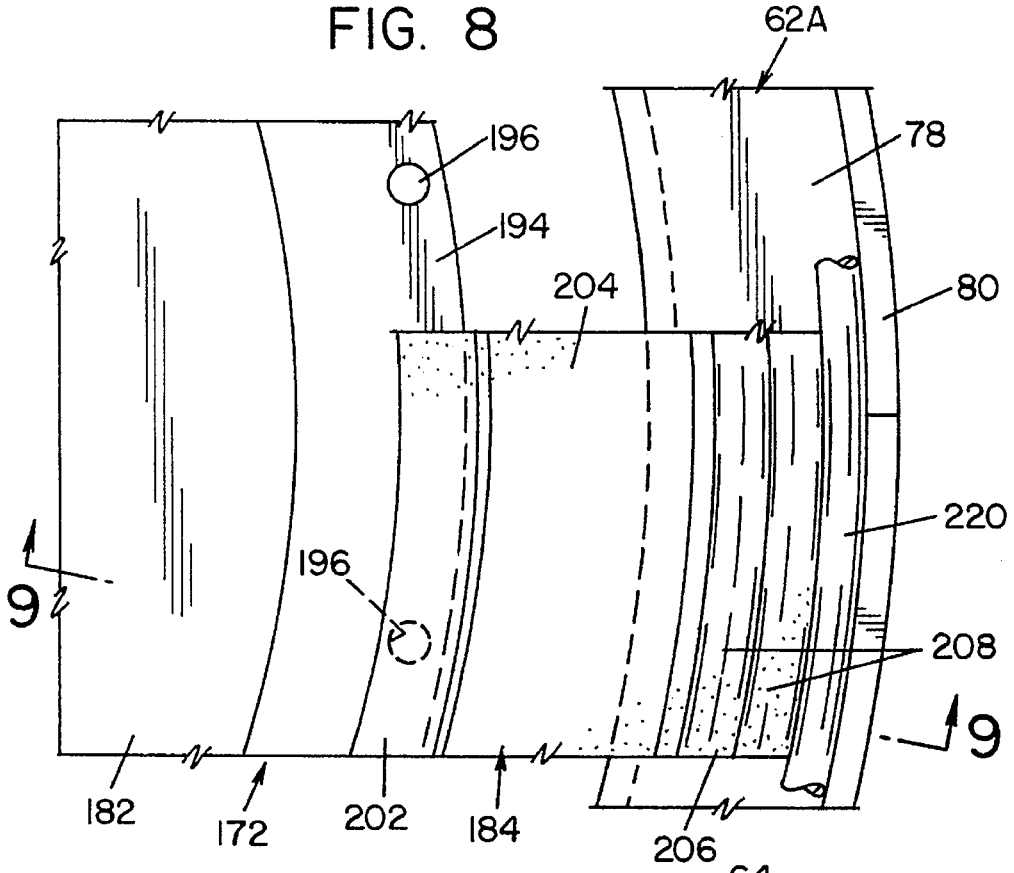
FIG. 8 is an enlarged plan view of the outer peripheral edge of the pressure sensor, showing the position of a diaphragm element relative to a sensor housing before final assembly.

In the embodiment shown, pressure sensitive members 172, 174 are identical, and therefore only one will be described in detail, it being understood that such description applies equally to the other. Pressure sensitive member 172 is generally comprised of a circular plate 182 having a resilient diaphragm element 184 attached thereto about the periphery thereof. Plate 182 is generally a flat circular disk preferably formed of a plastic material to have a cup shaped, generally cylindrical mounting boss 186 extending to one side thereof, which mounting boss 186 defines a recess 188 on the other side of plate 182. Plate 182 and mounting boss 186 are formed to be symmetrically about in axis extending through plate 182. A post 190 having a pin 192 formed on the free end thereof extends from recess 188 along the axis of plate 182. Plate 182 includes an outer peripheral edge 194 (best seen in FIGS. 8, 9 and 10) of reduced thickness having a plurality of spaced apart apertures 196 extending therethrough.

Figure 9:
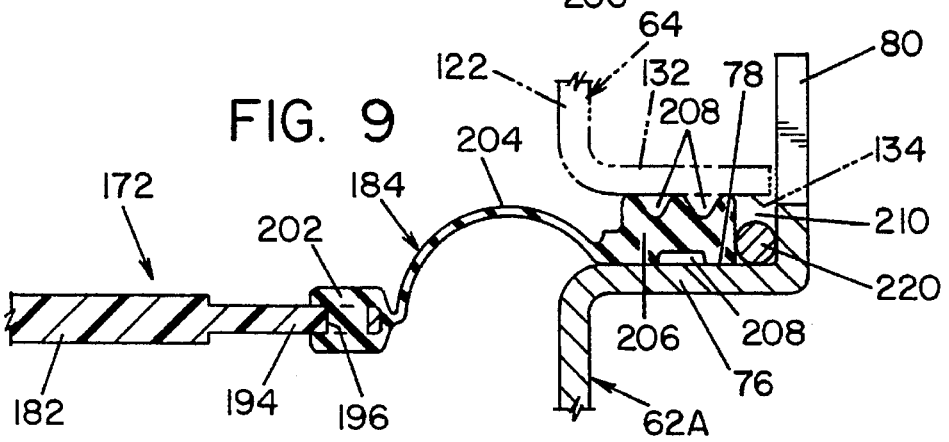
FIG. 9 is a sectional view taken along lines 9—9 of FIG. 8.
Figure 10:
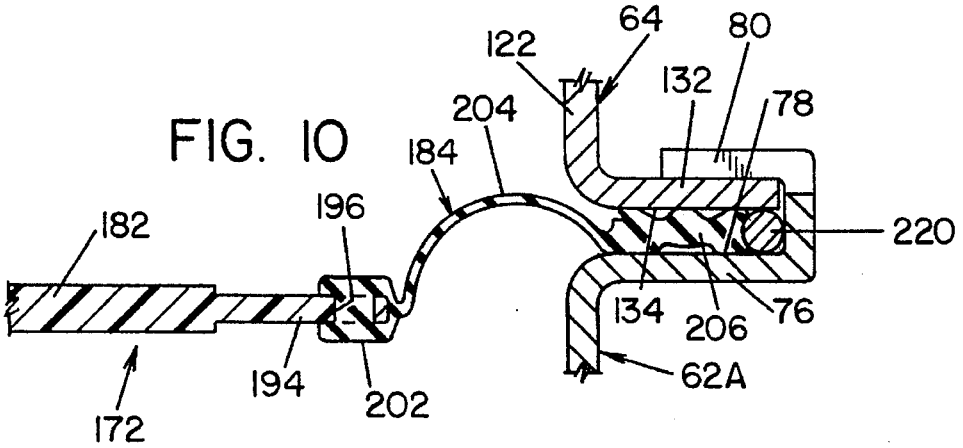
FIG. 10 is a sectional view of the edge of the diaphragm element in an assembled configuration.

Diaphragm element 184 is attached to plate 182 along peripheral edge 194. According to the present invention, diaphragm element 184 is generally formed of a resilient flexible elastomeric material which is molded to edge 194 of plate 182 (as best seen in FIGS. 9 and 10) to form an integral structure therewith. In the embodiment shown, diaphragm element 184 is preferably formed of a silicone rubber material. Diaphragm element 184 is generally comprised of enlarged inner portion 202 which is molded to peripheral edge 194 of plate 182, an intermediate convolute portion 204 and an outer gasket portion 206. As best seen in FIGS. 9 and 10, inner portion 202 is preferably molded to both sides of edge 194 with elastomeric material extending through apertures 196 to provide an interlocking connection with plate 182. Intermediate portion 204 is generally formed of uniform thickness and has a radius defined by the desired operating characteristics of the pressure sensitive member 172. In this respect, the shape of intermediate convolute portion 204 will define the displacement characteristics of the pressure responsive assembly 170. Outer gasket portion 206 is formed to include a plurality of recesses or cavities 208 and to have an outer diameter slightly less than the inner diameter defined by side wall 74 of housing section 62A. In this respect, a recess or space 210 is defined between the outer edge of gasket portion 206 and the inner surface of side wall 74.

According to one aspect of the present invention, top and bottom caps 64, 66 are secured to central housing 62 by crimping, i.e., bending, tabs 80 of central housing sections 62A, 62B around flanges 132, 162 of top and bottom caps 64, 66, as best seen in FIG. 6. In this respect, pressure sensitive members 172, 174 are dimensioned to be positioned respectively between upper cap 64 and central housing 62 and between lower cap 66 and central housing 62. Specifically, gasket portion 206 of diaphragm elements 184 are positioned between planar surfaces 78 of central housing 62 and planar annular surface 134 of upper cap 64, and planar annular surface 164 of lower cap 66, so as to be confined therebetween as best seen in FIG. 6. In this respect, gasket portion 206 of diaphragm element 184 is adapted to form a fluid tight seal between central housing 62 and upper cap 64 and lower cap 66. Specifically, as tabs 80 of central housing 62 are crimped on to flanges 132, 162 of upper cap 64 and lower cap 66, gasket portion 206 of diaphragm element 184 is deformed under the pressure exerted thereon. The cavities 208 formed in gasket portion 206 allow it to deform to seal the respective surfaces. Importantly, too much compression of the gasket portion 206 during the crimping process, can have the undesirable and disruptive effect of distorting convolute portion 204 of diaphragm element 184 thereby destroying or altering its designed pressure responsive characteristics. Accordingly, a spacing element 220, preferably formed of a rigid non-compressible material such as metal, is provided within space 210, defined between the outer edge of gasket portion 206 and the inner surface of side wall 74. 80 of central housing 62. Spacing element 220 establishes a minimum spacing between flanges 132, 162 of upper and lower caps 64, 66 and shoulder 76 of central housing 62 and provides a solid support or connection for crimping upper and lower caps 64, 66 to the central housing 62. At the same time, spacing element 220 limits compression and deformation of gasket portion 206 of diaphragm element 184 so as not to distort convolute portion 204.

Figure 11:
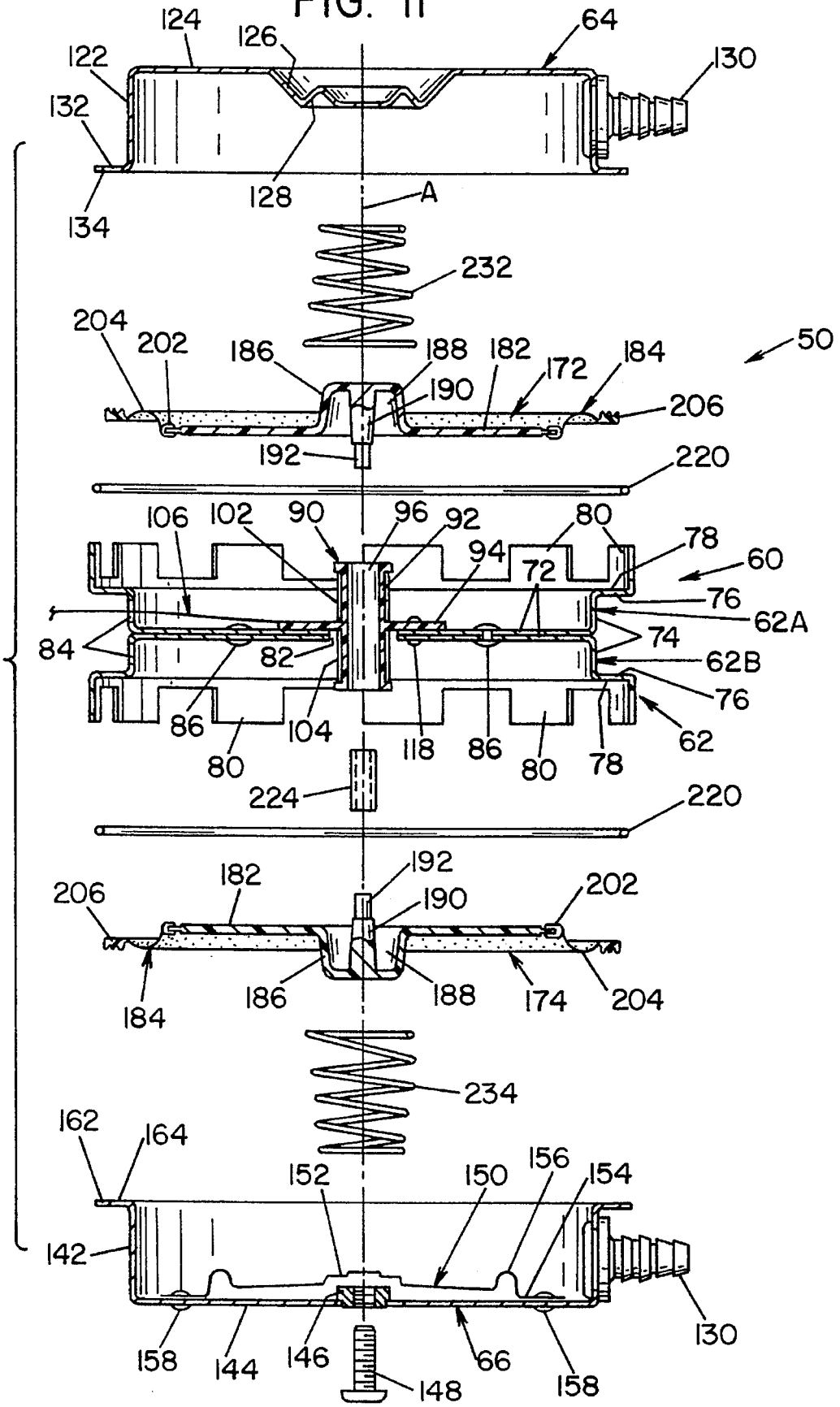
FIG. 11 is an exploded view of the pressure sensor shown in FIG. 3.

As best seen in FIG. 11, pressure sensitive members 172, 174 are oriented within body assembly 60, with posts 190 being coaxially aligned and extending toward each other. A portion of each post 190 is disposed within cylindrical passage 96 defined by spool 92. According to the present invention, pressure sensitive members 172, 174 are positioned to be coaxially aligned with the axis of spool 92. A cylindrical tube 224 formed of a conductive metal is mounted on, and attached to, pins 192 of pressure sensitive members 172, 174 to secure pressure sensitive member 172 to pressure sensitive member 174. As shown in FIG. 6, tube 224 is dimensioned to be slightly smaller than the diameter of cylindrical passage 96 so as to be freely movable along the axis thereof.

A first helical biasing spring 232 is disposed between pressure sensitive member 172 and upper cap 64. First biasing spring 232 is slightly conical in shape and is dimensioned such that one end thereof is positioned with in annular recess 128 formed in end wall 124, and the other end surrounds boss 186 on plate 182. In this position, first biasing spring 232 is generally coaxially aligned with axis "A." A second helical biasing spring 234 is disposed between pressure sensitive member 174 and lower cap 66. Second biasing spring 234 is also slightly conical and is dimensioned such that one end thereof surrounds crown portion 152 of adjusting plate 150, and the other end surrounds 186 boss on plate 182. First biasing spring 232 and second biasing spring 234 are dimensioned to have biasing forces wherein pressure responsive assembly 170 is generally centrally positioned within body assembly 60. Biasing springs 232, 234 are also dimensioned such that their working lengths are less than their free lengths throughout the linear movement of the pressure responsive assembly 170. A first fluid chamber 236 is defined between upper cap 64 and pressure sensitive member 172, and the second fluid chamber 238 is defined by lower cap 66 and pressure sensitive member 174.

In the embodiment shown, sensor 50 is mounted to a bracket 242 which is attached to body assembly 60 by rivets 244 fastened to upper cap 64 and lower cap 66. A circuit board 246 is attached to bracket 242. Mounted to circuit board 246 are sensor circuits (not shown) including signal generating components and signal processing components. In general, these circuits and components are connected to circuit paths 112, 114, 116 to develop electrical signals corresponding to changes in position of spoiler element 224 within coils 102, 104 as a result of the movement of pressure responsive assembly 170. Specifically, circuit board 246 includes circuitry of the type disclosed in U.S. Pat. Nos. 4,663,589; 4,777,436; 4,841,245; and 4,851,770 to Fiori, Jr., the disclosures of which are expressly incorporated herein by reference. Broadly stated, an indication of the position of spoiler 224 relative to coils 102, 104 is developed by measuring the resonant frequencies of coils 102, 104. In this respect, a pulse generator (not shown) develops a series of pulses of resonant frequency in each coil 102, 104. The relative time required to count the same number of pulses of each series of pulses provides and indication of the position of spoiler 224. Additional circuit means (not shown) may be provided to modify the sensor output to produce a desired electrical output signal corresponding to a specific position of spoiler 224. In this respect, circuit means are preferably provided to produce either a digital output or an analog output (or both), and to provide an offset to either output at zero differential. Further, means may be provided for varying the slope (i.e., full scale output) of either the digital output or the analog output (or both), and for producing a square root value for such outputs. Still further, the circuit means would include a dedicated display for displaying sensor output information in engineering units. A gain circuit or application circuit may be mounted to circuit board 246 to modify signals from the sensor circuitry to develop an output signal basically indicative of a specific pressure differential sensed by sensor 50. Sensor 50, as heretofore described, produces an output signal which may be described as "continuous," in the sense that sensor 50 can produce discreet signals at such a high processing rate that for practical purposes it is continuous for its application with respect to the present invention. Pin connectors 248 are attached to circuit board 246 to connect the circuitry thereon to furnace controller 40.

Figure 12:
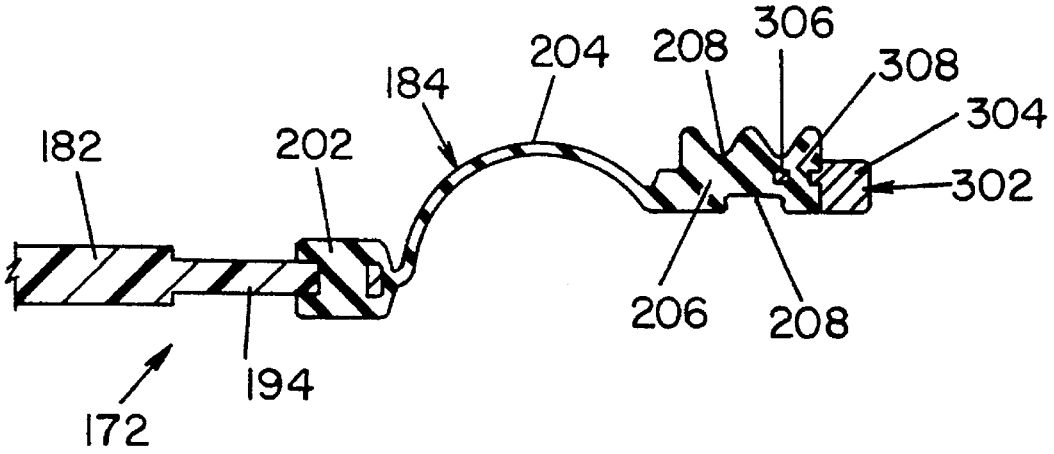
FIG. 12 and 13 are enlarged views of the peripheral edge of a diaphragm element illustrating an alternate embodiment thereof.
Figure 13:
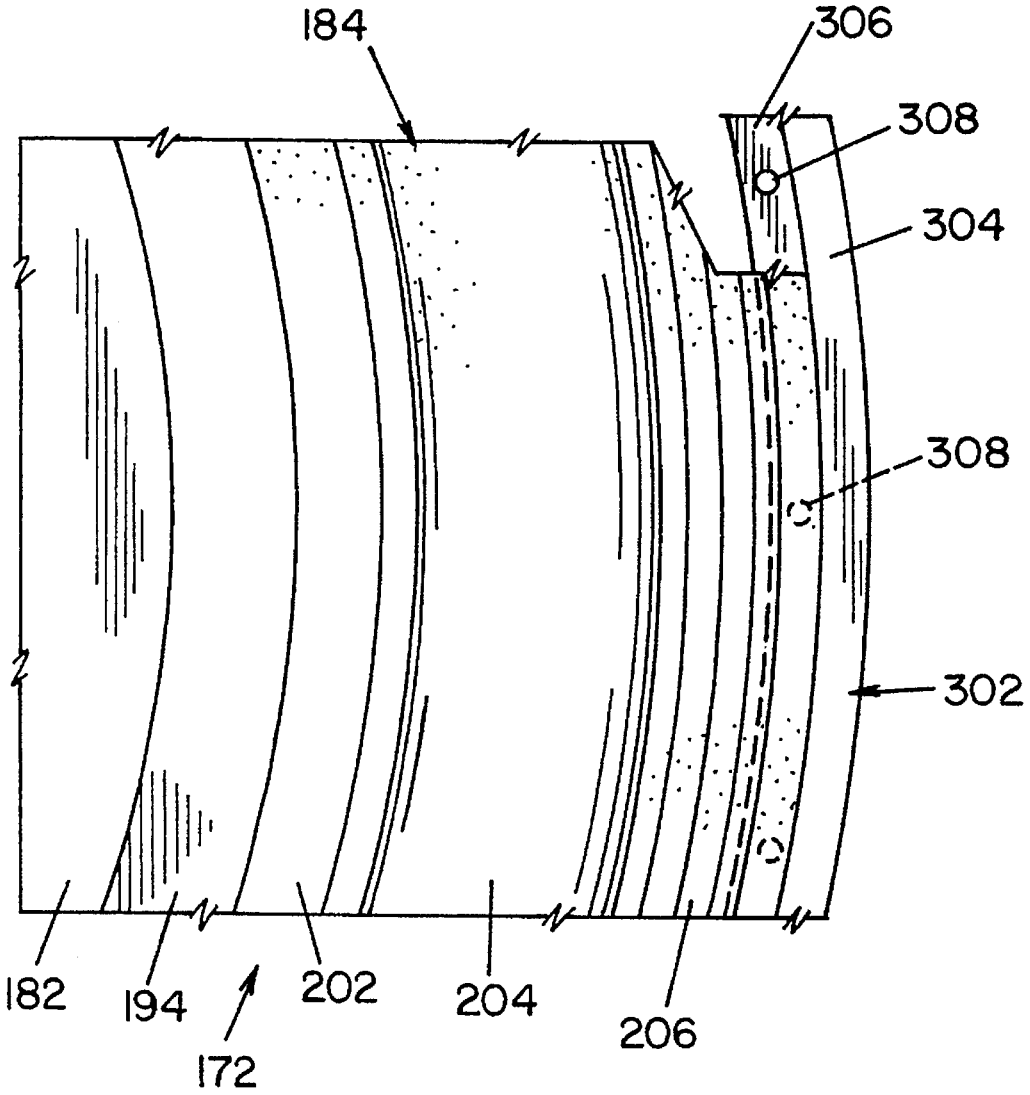
Figure 14:
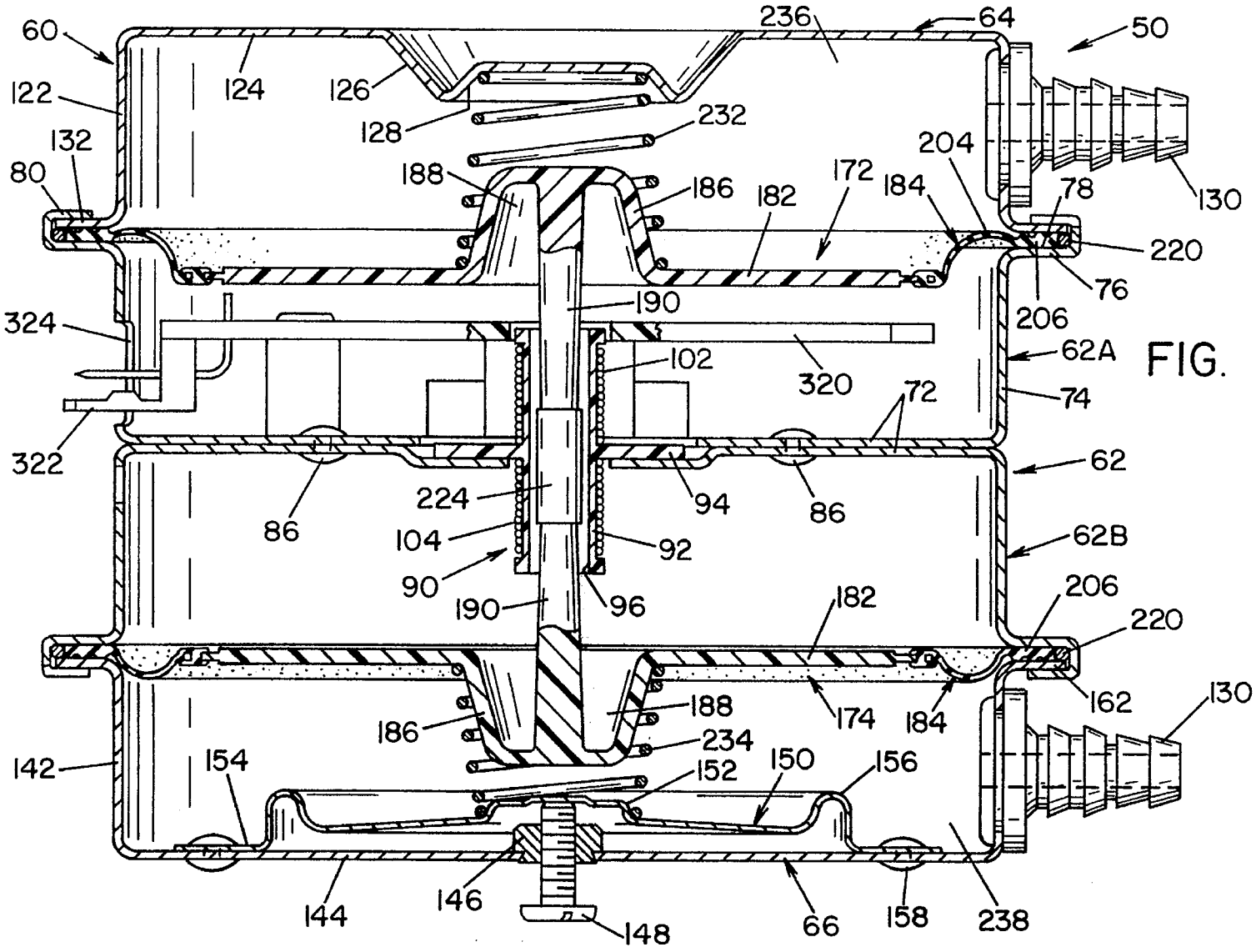
FIG. 14 is an enlarged cross sectional view of a pressure sensor illustrating an alternate embodiment of the present invention.

Alternate embodiments of sensor 50 are shown in FIGS. 12–14. Specifically, FIGS. 12 and 13 illustrate a diaphragm element 184 wherein a spacing element 302 is molded as part thereof. Spacer 302 is basically a circular ring with a body portion 304 having a rectangular cross section. A flange 306 having a plurality of spaced apart apertures 308 extends from body portion 304. Gasket portion 206 of diaphragm element 184 is molded onto flange 306 with the elastomeric material forming gasket portion 206 extending through apertures 308. In this respect, pressure sensitive member 172 is formed with a spacing element 302 as part thereof. As with spacing element 220 described above, spacing element 302 establishes a minimum spacing between flanges 134, 164 of upper and lower caps 64, 66, and shoulder 76 of central housing 62 to prevent distortion of convolute portion 204 of diaphragm element 184.

Referring now to FIG. 14, an alternate embodiment of sensor 50 is shown, wherein a circuit board 320 for containing the sensor circuits described is mounted within housing 62. More specifically, in the embodiment shown, housing section 62A, 62B are actually elongated to increase the spacing defined between pressure sensitive members 172, 174. To accommodate this increase spacing, post 190 on pressure sensitive members 172, 174 are also elongated. The increased spacing defined by elongated housing section 62A, 62B allows circuit board 320 to be positioned within housing 62 with male connectors 322 extending through an opening 324 formed an elongated housing section 62A. The embodiment shown in FIG. 14 thus provides a self-contained sensor unit which is easily connectable to furnace control 40.

THE CONTROLLER

Controller 40 is generally comprised of a processing unit together with a memory system comprised of a ROM and a RAM. The ROM provides program instructions to controller 40, and RAM stores temporary data such as current inducer motor speed, current transducer signal outputs, etc.

As indicated above, controller 40 communicates with the plurality of system components, as best seen in FIG. 2. Specifically, in the embodiment shown, controller 40 receives input signals from sensor 50, thermostat 11, and a flame detect sensor 27. In response to signals received from such components, together with empirical or theoretically calculated preferred operating parameters stored in memory, controller 40 controls fuel flow to pilot 23 and burners 24, 25, ignitor 21, and motor 36 through motor speed controller 38.

Figure 15:
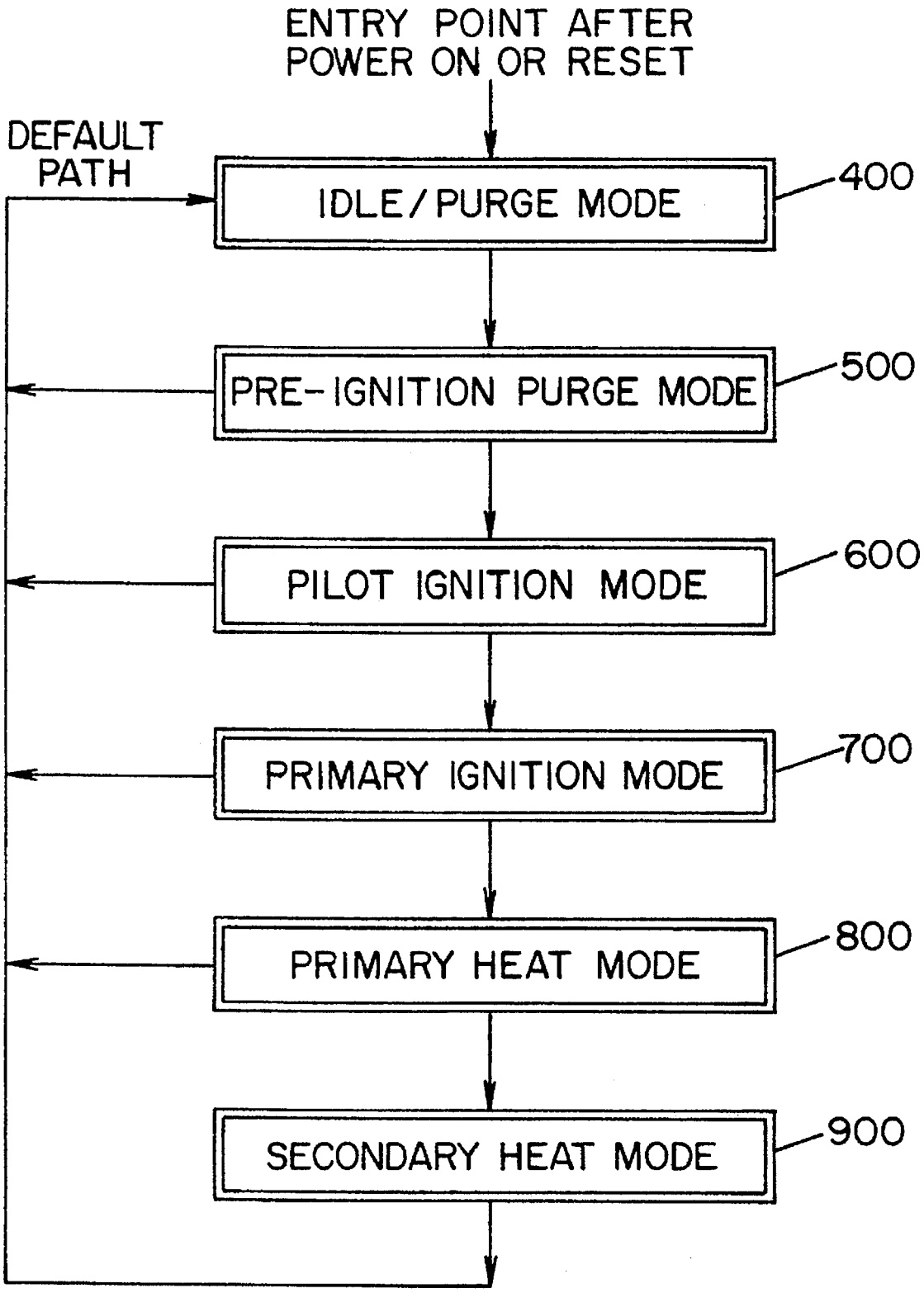
FIG. 15 is a block diagram showing the operating sequence of a furnace control system illustrating a preferred embodiment of the present invention.

In the embodiment shown, controller 40 is programmed to operate furnace 10 in six (6) distinct modes of operation. A flow chart showing the six (6) modes and their sequence of operation is shown in FIG. 15. The respective modes have been identified and designated:

1) an Idle/Purge Mode 400;

2) a Pre-Ignition Purge Mode 500;

3) a Pilot Ignition Mode 600;

4) a Primary Burner Ignition Mode 700;

5) a Primary Heat Operation Mode 800; and 6) a Secondary Heat Operation Mode 900.

As will be understood from a further reading of the present specification, each of the operating modes requires separate and distinct flow requirements through the heat exchanger assembly 18 for optimum furnace performance. According to the present invention, optimum flow data for each mode is established, either empirically by testing a given furnace design, or theoretically by calculation based upon such design, and such data is stored in the memory of controller 40. In this respect, for each operating mode, a predetermined "ideal operating flow value" relating to the desired flow through heat exchanger assembly 18 has been stored in memory. The ideal operating flow value for each operating mode is used as a reference during operation in such mode as will be described in greater detail below. It should be noted that the foregoing mode identifications and designations have been selected solely for the purpose of illustrating the present invention, and are not intended to limit same. In this respect, while the embodiment shown includes six (6) distinct operating modes, it will be appreciated by those skilled in the art that each operating mode is not required and may not be desirable in a particular furnace system. For example, Idle/Purge Mode 400, which will be described in greater detail hereinafter, is provided as a safety feature to purge stray gas from a furnace when the furnace is idle, but is not per sea necessary or essential operating feature of a furnace. Further, while a Pilot Ignition Mode 600 is shown, many conventional furnaces do not include a pilot burner, but rather ignite a primary burner by means of a "hot surface." Thus, a furnace system, according to the present invention, need not include a Pilot Ignition Mode 600.

1) Idle/Purge Mode 400

Idle/Purge Mode 400 is basically a default mode in which furnace 10 will operate when no demand for heat is indicated by thermostat 11 or in the event conditions required for operating other modes cannot be met. More specifically, controller 40 is programmed such that in this mode, inducer motor 36 (and thus inducer fan 34) is periodically activated to run "purge cycles" to evacuate any residual or stray gas within the system. These periodic "purge cycles" follow "idle cycles" where inducer motor 36 is "off."

Figure 16:
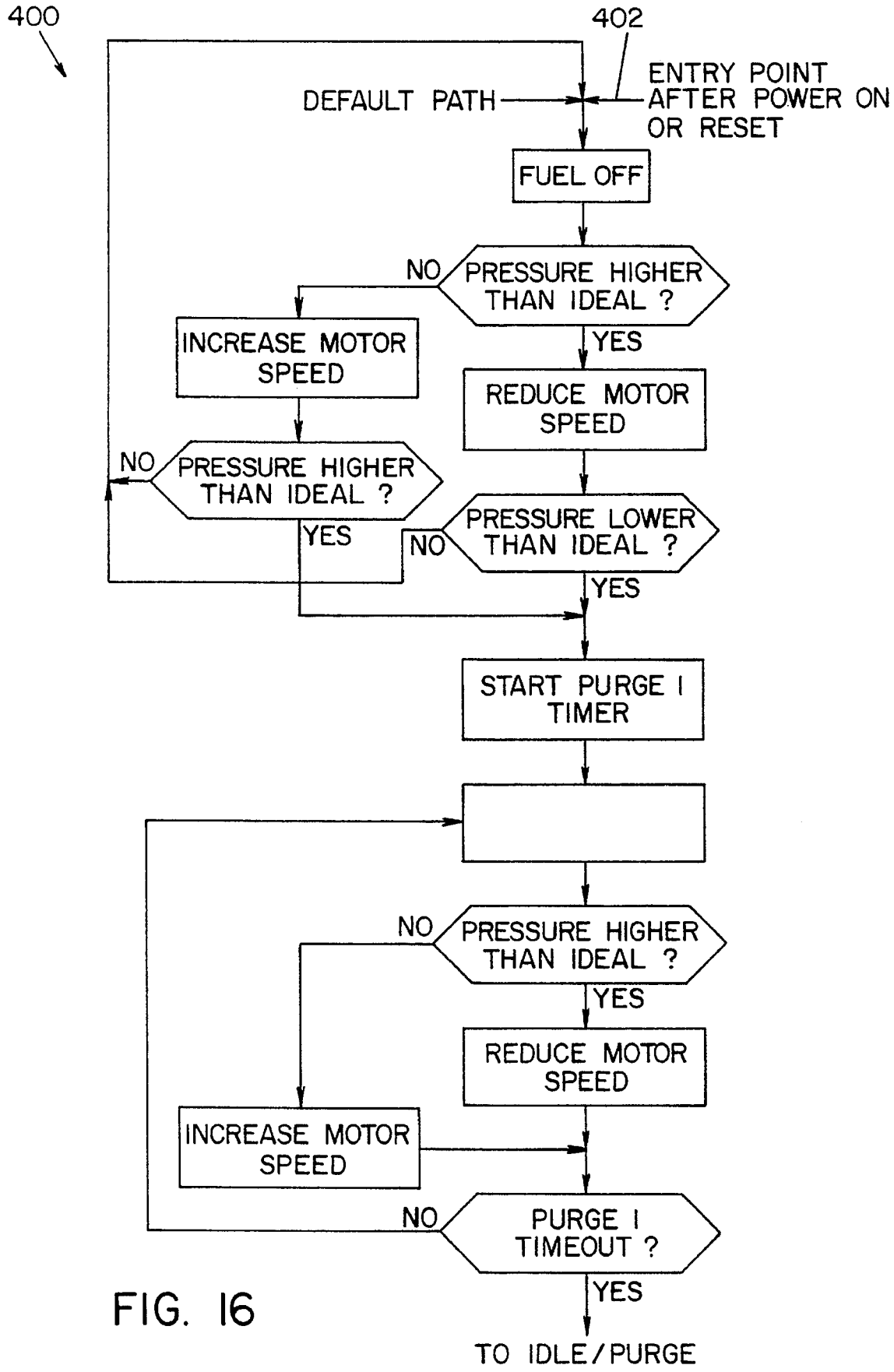
FIG. 16 and 16A together are a flow diagram of the operation of Idle/Purge Mode 400 of the present invention.
Figure 16A:
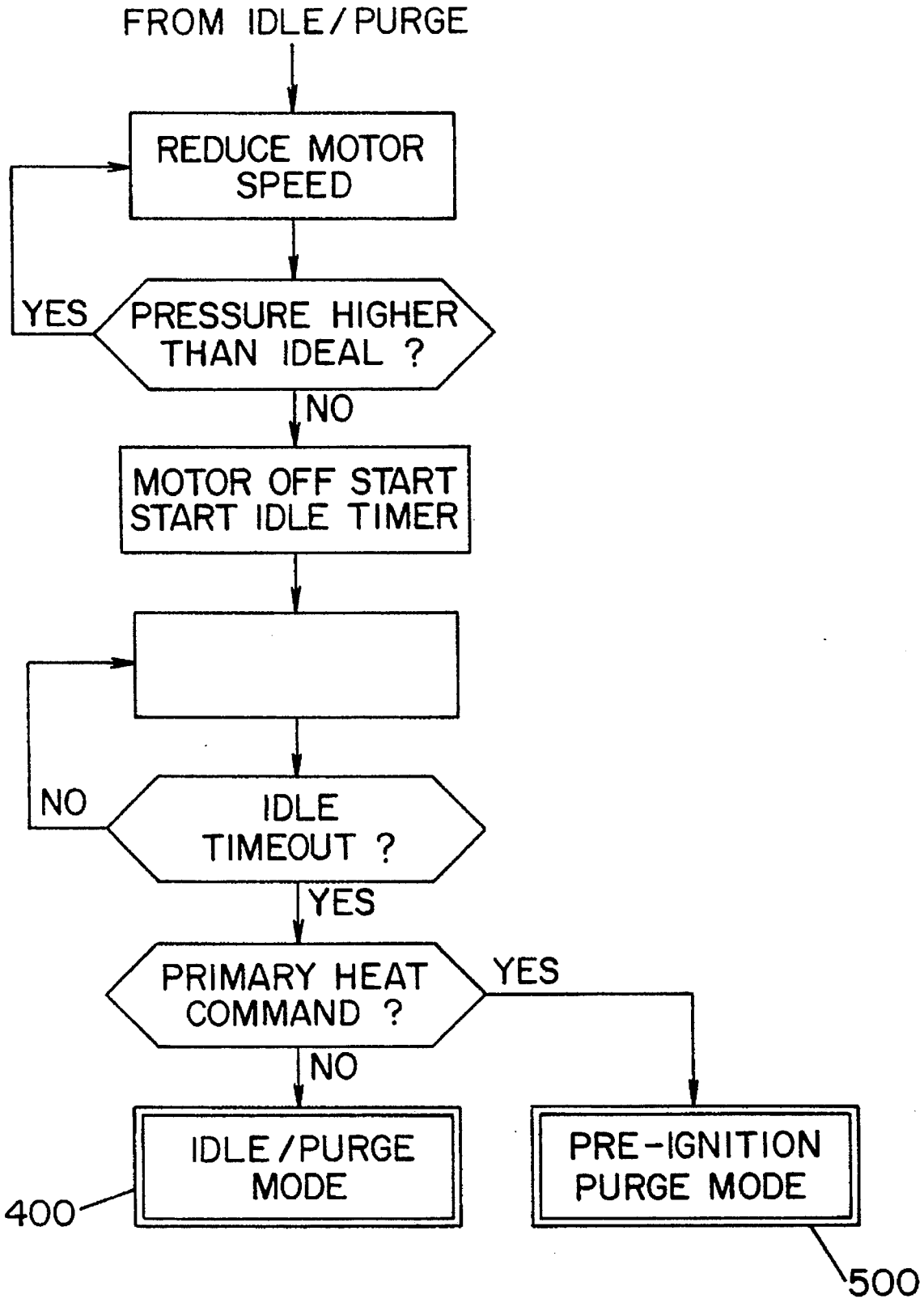

Referring now to FIG. 16 and 16A, a logic-flow diagram of operations in Idle/Purge Mode 400 is shown. As shown in FIG. 16, entry point 402 into Idle/Purge Mode 400 takes place upon applying power to the system, under a reset condition, or as a default from another operating mode as will be described below.

As the system enters Idle/Purge Mode 400, fuel flow to pilot 23 and burners 24, 25 are "off". Inducer motor 36 may or may not be running depending upon whether the Idle/Purge Mode 400 is entered under a reset condition, i.e., following an idle cycle, or a default condition. If Idle/Purge Mode 400 is entered under a default condition, inducer motor 36 would typically be operating. If Idle/Purge Mode 400 is entered under a reset condition, a basic start up sequence is initiated by controller 40. Basically, controller 40 would cause inducer motor 36 to start up, which creates a pressure differential across taps 44, 46. Under either situation, controller 40 monitors the digital output signal of sensor 50 and compares it to the "ideal operating flow value" stored in memory. As indicated above, the output from sensor 50 is a digital electronic signal indicative of a pressure differential sensed across taps 44, 46. This electrical value is indicative of a pressure drop across heat exchanger assembly 18, which pressure drop corresponds to the flow therethrough as can be calculated based upon the established scientific principles of fluid flow. Two conditions can exist at the initial step of Idle/Purge Mode 400: 1) the pressure differential sensed by sensor 50 can be higher than the "ideal operating flow value" stored in memory, or 2) the pressure differential sensed by sensor 50 can be below the "ideal operating flow value."

If the pressure differential sensed by sensor 50 is higher than the pressure differential which would exist at the "ideal operating flow value," controller 40 instructs inducer motor 36 to slow down the speed of inducer fan 34, which in turn creates a reduction in the pressure drop across heat exchanger assembly 18 that is detected by sensor 50. Controller 40 monitors the pressure drop across heat exchanger assembly 18 by means of the output signals of sensor 50 and can slow down inducer motor 36 until a sensed pressure drop across taps 44, 46 produces an electrical signal output from sensor 50 which is below the "ideal operating flow value" for Idle/Purge Mode 400.

If the sensed pressure differential across taps 44, 46 produces an output signal from sensor 50 which is below the ideal operating flow value stored in memory, controller 40 causes inducer motor 36 to increase in speed, thereby increasing the pressure drop sensed by sensor 50 across taps 44, 46. The continuous monitoring of the pressure drop across taps 44, 46 by sensor 50 enables controller 40 to cause inducer motor 36 to speed up until the sensed pressure differential produces an output signal from sensor 50 which exceeds the "ideal operating flow value" stored in memory.

In other words, at the beginning of Idle/Purge Mode 400, controller 40 causes the flow through heat exchanger assembly 18 to adjust initially to the ideal operating flow stored in memory. Thus, if the output signal from sensor 50 indicates a flow greater than the "ideal flow" (i.e., a pressure differential greater than the pressure differential that would exist at "ideal flow"), controller 40 causes motor 36 to slow down thereby reducing the flow through heat exchanger assembly 18 and reducing the pressure differential sensed by sensor 50. On the other hand, if the output signal from sensor 50 indicates a flow less than the "ideal flow," controller 40 causes inducer motor 36 to speed up to increase the flow through heat exchanger assembly 18.

Once either condition first occurs, a purge timer is started to initiate a "purge cycle." During this "purge cycle," the output signal of sensor 50 is monitored by controller 40 to enable it to maintain the flow through heat exchanger assembly 18 at the "ideal operating flow value." As above, this is accomplished by controller 40 increasing or decreasing the speed of inducer motor 36 in response to the output signal of sensor 50 and its deviation from the "ideal operating flow value" stored in memory. The system is operated under these conditions until the purge timer times out which marks the end of the "purge cycle." At this point, controller 40 reduces the speed of inducer motor 36, and checks to determine that the pressure drop across taps 44, 46, as sensed by sensor 50, is less than the "ideal operating flow value." If this condition exists, controller 40 shuts "off" inducer motor 36, and starts an "idle timer," which marks the beginning of the "idle cycle." The idle cycle lasts a predetermined period during which inducer motor 36 remains "off" (i.e., idle). At the end of the idle cycle, controller 40 checks if a heat demand has been received from thermostat 11. If no demand for heat is present at the end of the idle cycle, controller 40 returns to the beginning of Idle/Purge Mode 400 and proceeds again therethrough.

Accordingly, so long as no heat demand is present at the end of each sequence through Idle/Purge Mode 400, controller 40 will repeat such sequence. The periodic purging of furnace 10 while in Idle/Purge Mode 400 is intended to prevent a buildup of fugitive gas or fuel in the system while it remains idle.

If at the end of Idle/Purge Mode 400, controller 40 receives a heat demand from thermostat 11, controller 40 proceeds to Pre-Ignition Purge Mode 500.

2) Pre-Ignition Purge Mode 500

Pre-Ignition Purge Mode 500 (shown schematically in FIG. 17) is basically provided to purge furnace 10 of fugitive or residual fuel prior to ignition of pilot 23 and burners 24, 25. As with Idle/Purge Mode 400, Pre-Ignition Purge Mode 500 has a pre-determined "ideal operating flow value" stored in memory of controller 40 that is representative of the desired ideal operating conditions of furnace 10 when in this operating mode. As will be appreciated, the ideal operating flow value of Pre-Ignition Purge Mode 500 may or may not be the same as the ideal operating flow value of Idle/Purge Mode 400.

Figure 17:
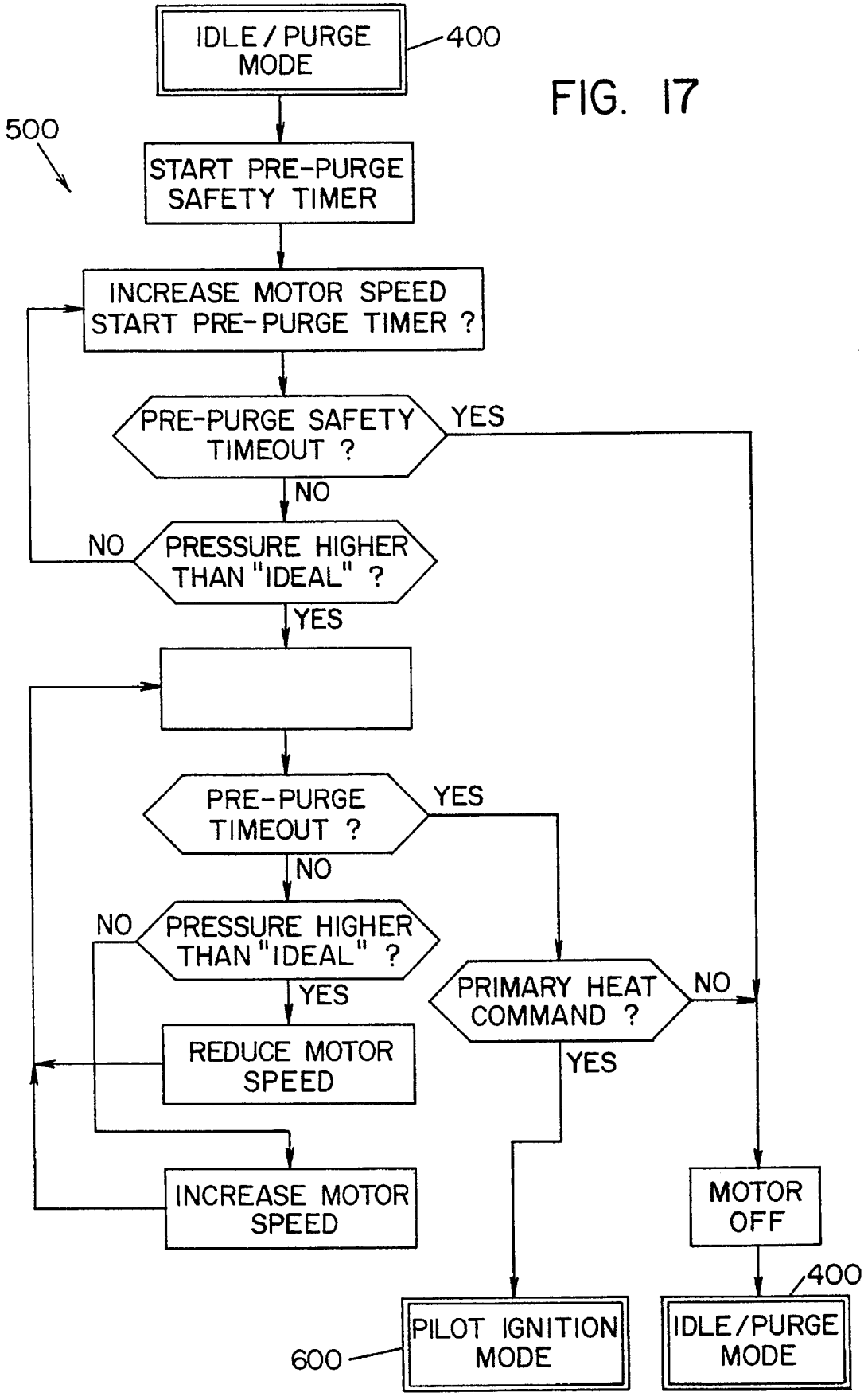
FIG. 17 is a flow diagram of the operation of a Pre-Ignition Purge Mode of the present invention.

As the system enters Pre-Ignition Purge Mode 500, a safety timer is started. This safety timer is set for a predetermined period, and is provided in the event that a required operating condition (i.e., the "ideal operating flow value" for the Pre-Purge Mode) cannot be met within the time period set by the safety timer. In this respect, as schematically illustrated in FIG. 17, after initiation of the safety timer, controller 40 increases the speed of inducer motor 36 to increase the pressure differential across taps 44, 46. At the same time, controller 40 initiates a pre-purge timer. Controller 40 will cause inducer motor 36 to speed up until the differential pressure across taps 44, 46 sensed by sensor 50 produces an output signal having a value which surpasses the ideal operating flow value stored in memory for Pre-Ignition Purge Mode 500. In the event that the system cannot meet this condition before the pre-purge safety timer times out, controller 40 will default (i.e., return) the system to Idle/Purge Mode 400.

If the desired pressure differential sensed by sensor 50 is established before the pre-purged safety timer times out, inducer motor 36 continues to operate. In this respect, controller 40 monitors the output signals of sensor 50 and in response to the output values provided thereby regulates the speed of inducer motor 36 to adjust operation of the system to the ideal operating flow value stored in memory.

The system is maintained under these conditions until the pre-purged timer has timed out, at which point controller 40 determines whether a demand for heat exists from thermostat 11. If so, controller 40 proceeds to Pilot Ignition Mode 600. If no demand for heat is present when the pre-purged timer times out, controller 40 defaults back to Idle/Purge Mode 400.

Thus, in summary, in Pre-Ignition Purge Mode 500, inducer blower 34 is run at a level to establish a minimum desired pressure differential across taps 44, 46 of heat exchanger assembly 18. Inducer blower 34 operates for a predetermined period of time to evacuate any fugitive fuel which may be present in the system prior to pilot ignition.

3) Pilot Ignition Mode 600

Figure 18:
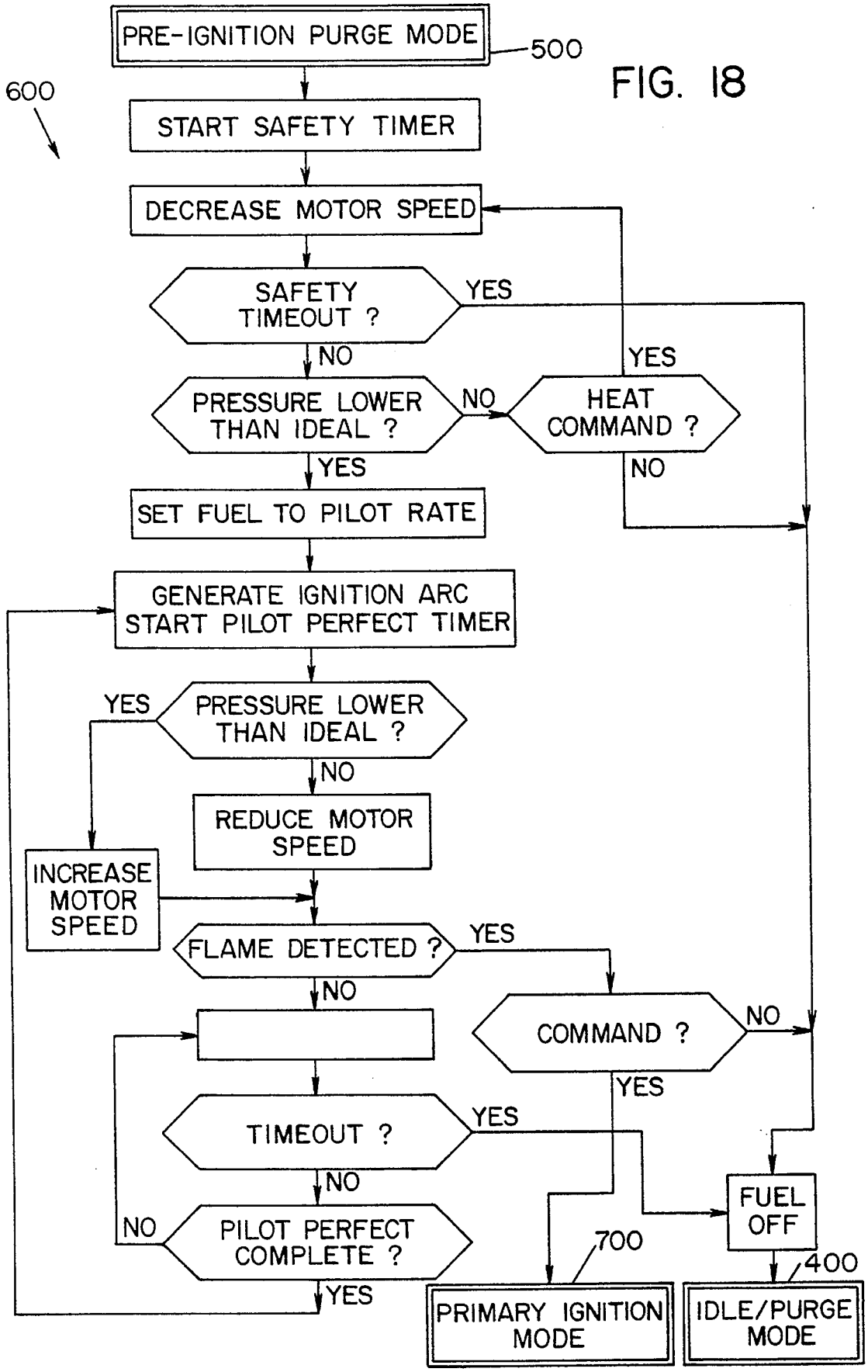
FIG. 18 is a flow diagram of the operation of a Pilot Ignition Mode of the present invention.

Referring now to FIG. 18, Pilot Ignition Mode 600 is schematically illustrated. As the system enters Pilot Ignition Mode 600, a pilot ignition safety timer is started. As with the pre-purge safety timer, a time period is established in Pilot Ignition Mode 600 in which certain operating conditions must be met or controller 40 will cause the system to default to Idle/Purge Mode 400. Further, as with the foregoing operation modes, in Pilot Ignition Mode 600, an ideal operating flow "value" corresponding to ideal operating conditions in this mode has been established and stored in memory. As will be appreciated, air flow necessary to establish pilot ignition will generally be substantially less than the ideal operating flow conditions in the Pre-Ignition Purge Mode 500. Accordingly, controller 40 causes inducer motor 36 to reduce speed until the pressure differential sensed by sensor 50 produces an output value corresponding to the pre-determined "ideal operating flow value" stored in memory for Pilot Ignition Mode 600.

Periodic comparisons between the output signal of sensor 50 and the ideal operating flow value are made as the speed of inducer motor 36 is reduced. With each comparison, controller 40 checks if a demand for heat still exists from thermostat 11. If a demand for heat no longer exists, controller 40 defaults the system to operation in Idle/Purge Mode 400. If a demand for heat still exists, the speed of inducer motor 36 is continually reduced until the output signal of sensor 50 drops below the ideal operating flow value stored in memory for Pilot Ignition Mode 600. At this time, controller 40 causes pilot valve 15 to open to allow fuel to the pilot. At the same time, controller 40 causes an ignition arc to be generated by ignitor 21, and a pilot perfect timer to be started.

Controller 40 regulates the speed of inducer motor 36 in response to the output signals received from sensor 50. If the signal from sensor 50 indicates that the actual pressure drop across taps 44, 46 is less than the ideal pressure drop (which corresponds to the ideal operating flow value stored in memory), the speed of inducer motor 36 is increased which results in an increase in the pressure drop across heat exchanger assembly 18. If the signal generated by sensor 50 indicates that the actual pressure drop across taps 44, 46 is greater than the ideal pressure differential (i.e., greater than the ideal operating flow value), the speed of inducer motor 36 is decreased which results in a decrease in the pressure drop across heat exchanger assembly 18.

Controller 40 then monitors flame detect sensor 27 to determine if a flame is present at the pilot 23. If a flame is not detected, controller 40 determines whether the pilot ignition safety timer has timed out. If so, fuel flow to the pilot 23 is shut off, and the system defaults to Idle/Purge Mode 400. If the pilot ignition safety timer has not timed out, controller 40 determines if the pilot ignition perfect timer has timed out. If not, controller 40 waits until such timer has timed out, then proceeds to re-start the pilot ignition sequence. The pilot ignition sequence is repeated until the pilot flame is detected or the pilot ignition safety timer has timed out wherein controller 40 causes fuel to pilot 23 to be turned off and the system to default to Idle/Purge Mode 400.

During the pilot ignition sequence, if a flame is detected by flame detect sensor 27, controller 40 determines if a demand for heat still exists from thermostat 11. If no demand for heat exists, fuel to pilot 23 is turned off, and the system defaults to Idle/Purge Mode 400. If a demand for heat exists, controller 40 causes the system to begin Primary Ignition Mode 700.

4) Primary Ignition Mode 700

Referring now to FIG. 19, a schematic logic diagram of Primary Ignition Mode 700 is shown. As the system enters Primary Ignition Mode 700, a primary ignition mode safety timer is started. As with the foregoing modes, a time period is established in which certain operating conditions must be met, or controller 40 shall default the system to Idle/Purge Mode 400. As will be appreciated, the desired flow rate through the heat exchanger assembly 18 during the primary ignition sequence is substantially higher than the desired flow rate during pilot ignition sequence. Accordingly, controller 40 instructs inducer motor 36 to speed up to increase the pressure differential across the heat exchanger assembly 18 in anticipation of the primary gas valve opening. Controller 40 then opens primary valve 17 to primary burners 24 to pass fuel thereto. An ideal operating flow value has been established in memory for Primary Ignition Mode 700. Controller 40 monitors the output value of sensor 50 and compares same to the ideal operating flow value. Controller 40 continues to increase the speed of inducer motor 36 until the output value of sensor 50 has exceeded the ideal operating flow value stored in memory. In the event that the output value of sensor 50 does not reach the ideal operating flow value prior to the time out of the primary ignition safety timer, controller 40 causes primary valve 17 to shut off fuel to primary burners 24 and defaults the system to Idle/Purge Mode 400. If the primary ignition safety timer has not timed out, and the output value of sensor 50 has exceeded the ideal operating flow value stored in memory, controller 40 initiates a flow maintenance routine wherein controller 40 monitors the output of sensor 50 and increases or reduces the speed of inducer motor 36 in response to comparisons of the output value of sensor 50 against the ideal operating flow value stored in memory. In this respect, controller 40 maintains the ideal operating flow value, and thus the ideal flow conditions through heat exchanger assembly 18 until primary condition timer has timed out. At this point, controller 40 monitors flame detect sensor 27 to determine if a flame is present at primary burners 24. If no flame is detected, controller 40 causes the primary valve 17 to shut off fuel to primary burners 24, and then defaults the system to Idle/Purge Mode 400 of operation. If a flame is detected by flame detect sensor 27, controller 40 closes pilot valve 15 and enters Primary Heat Mode 800.

5) Primary Heat Mode 800

Figure 20:
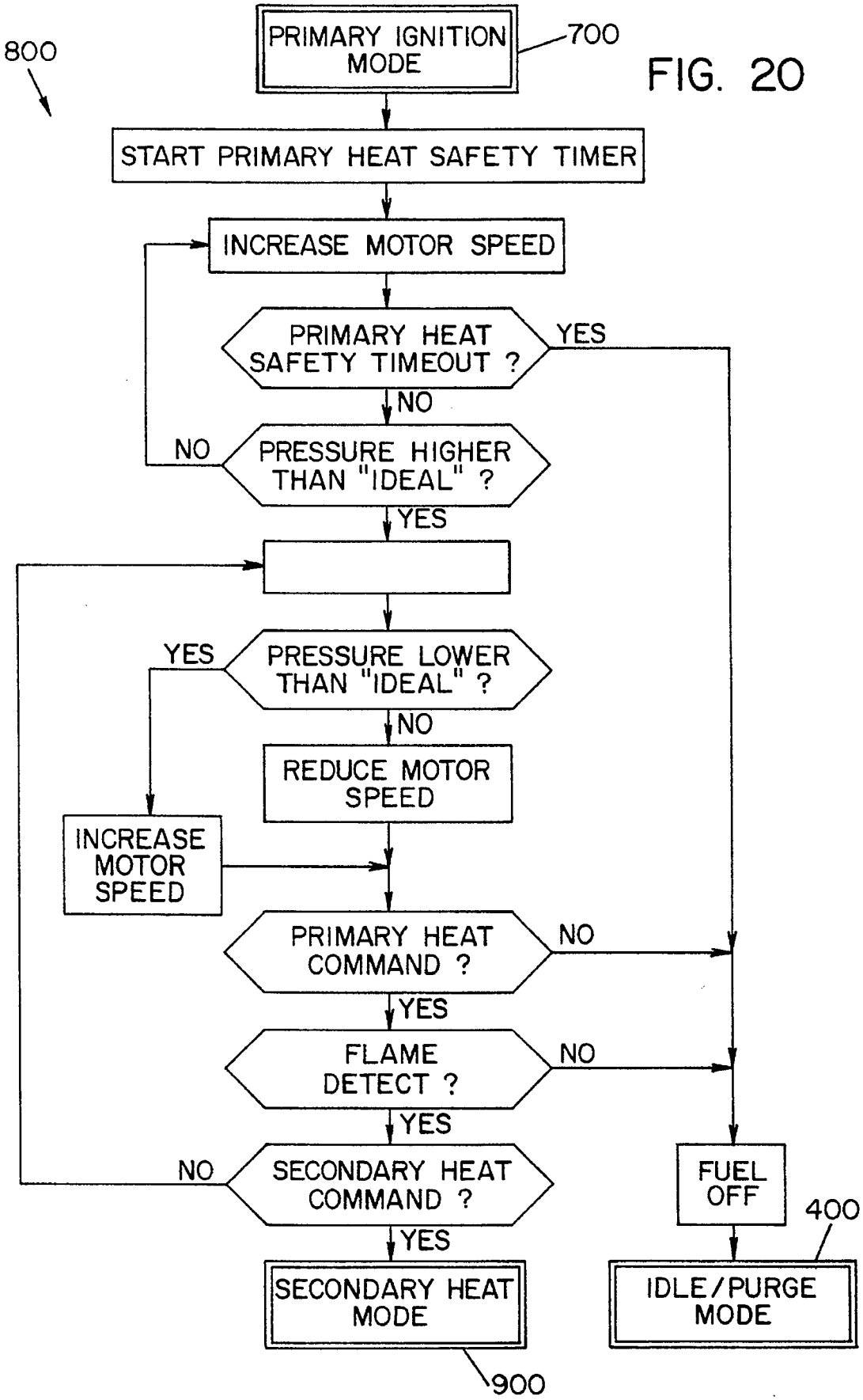
FIG. 20 is a flow diagram of the operation of a Primary Heat Mode of the present invention.

Referring now to FIG. 20, a logic diagram for Primary Heat Mode 800 is shown. As the system enters Primary Heat Mode 800, a primary heat safety timer is started. In Primary Heat Mode 800, the ideal operating flow value set in memory represents a greater pressure differential across heat exchanger assembly 18 than that for Primary Ignition Mode 700. Accordingly, the speed of inducer motor 36 must be increased to increase the pressure drop across taps 44, 46. Primary heat safety timer provides a safety feature in the event that the system cannot obtain the required operating condition (i.e., of increasing the pressure drop across the heat exchanger to produce an output value from sensor 50 which exceeds the ideal operating flow value stored in memory) within a set period of time.

Accordingly, as shown in FIG. 20, at the initiation of Primary Heat Mode 800, controller 40 increases the speed of inducer motor 36. If the primary heat safety timer times out prior to controller 40 receiving an output value from sensor 50 exceeding the ideal flow value stored in memory, controller 40 causes primary valve 17 to remain closed, thus preventing the flow of fuel to primary burners 24 and defaults the system to Idle/Purge Mode 400. If the output value from sensor 50 meets or exceeds the ideal operating flow value established in memory for Primary Heat Mode 800 prior to time out of the primary heat safety timer, controller 40 instructs primary valve 17 to open and allow fuel to flow to the primary burner, initiates operation of circulation blower 22 for transfer of the burner output energy to the heated space of the building, and also begins a flow maintenance sequence wherein it monitors the output value from sensor 50 and increases or decreases the speed of inducer motor 36 to adjust such output to the ideal operating flow value. During each maintenance sequence, in addition to monitoring the output of sensor 50 and adjusting the speed of inducer motor 36 based on same, controller 40 checks if a demand for heat still exists from thermostat 11 and whether a flame is still detected by flame detect sensor 27. In the event that a demand for heat no longer exists from thermostat 11 or the flame is no longer detected by flame detect sensor 27, controller 40 causes primary valve 17 to cutoff fuel to primary burners 24 and defaults the system to Idle/Purge Mode 400. If a heat request from thermostat 11 exists and a flame is detected by sensor 27, controller 40 determines whether a demand for secondary heat exists. If no demand for secondary heat exist, controller initiates another flow maintenance sequence and continues such sequence until: 1) a demand for heat no longer exists, 2) a flame is no longer detected, or 3) a demand for secondary heat exists. If a demand for secondary heat exists, controller 40 causes the system to enter Secondary Heat Mode 900.

In summary, in Primary Heat Mode 800, controller 40 basically monitors the output of sensor 50 and compares same to the ideal operating flow value stored in memory and regulates the speed of inducer motor 36 to maintain the desired pressure drop across heat exchanger assembly 18. If a flame out condition is detected, or the demand for heat no longer exists, the system defaults to Idle/Purge Mode 400. If secondary heat is required, controller 40 initiates Secondary Heat Mode 900.

6) Secondary Heat Mode 900

Figure 21:
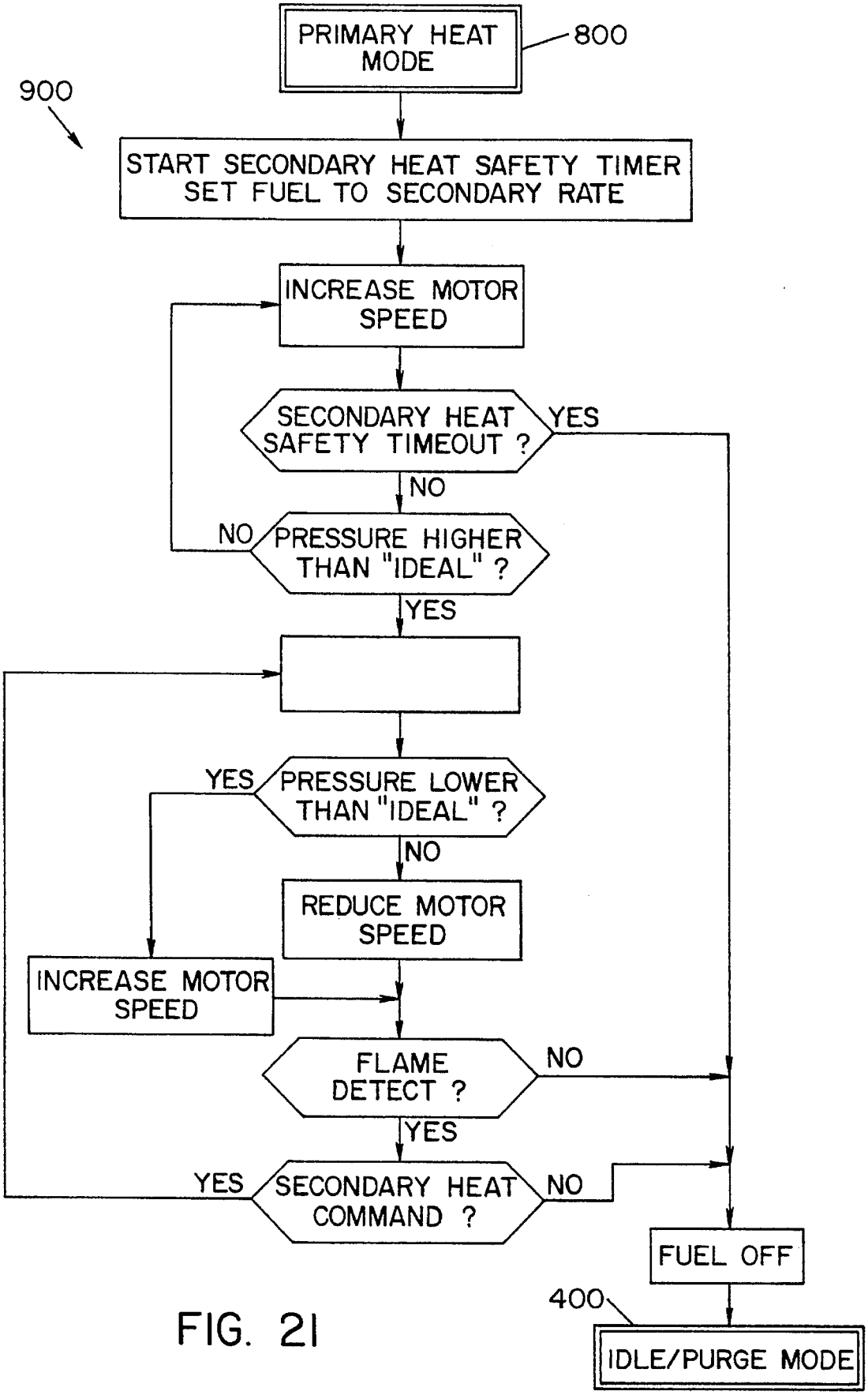
FIG. 21 is a flow diagram of the operation of a Secondary Heat Mode of the present invention.

Referring now to FIG. 21, a logic schematic for Secondary Heat Mode 900 is shown. As the system enters Secondary Heat Mode 900, a secondary heat safety timer is started. As with Primary Heat Mode 800, a time period is established in Secondary Heat Mode 900 as a safety feature in the event that a required operating condition is not or cannot be met. In this respect, in Secondary Heat Mode 900, secondary valve 19 is opened to provide fuel to secondary burners 25 which are ignited by primary burner 24. The increased fuel flow to secondary burners 25 requires increased air flow for ideal combustion. Accordingly, the desired pressure drop across heat exchanger assembly 18 will be greater than that required in Primary Heat Mode 800. In this respect, an ideal operating flow value for operation in Secondary Heat Mode 900 is stored in memory. This flow value represents an increase in the pressure drop across heat exchanger assembly 18 that is represented by the ideal operating flow value in Primary Heat Mode 800. Accordingly, controller 40 increases the speed of inducer motor 36 to increase the pressure drop across heat exchanger assembly 18. The output value of sensor 50 is monitored, and the speed of inducer motor 36 increased until the output signal of sensor 50 exceeds the ideal operating flow value stored in memory for Secondary Heat Mode 900. If the output value of sensor 50 does not reach the ideal operating flow value before the secondary heat safety timer times out, controller 40 shuts off fuel to the primary and secondary burners 24, 25 and defaults the system to Idle/Purge Mode 400. If the output value of sensor 50 exceeds the ideal operating flow value prior to the time out of secondary heat safety timer, controller 40 initiates a flow monitoring and maintenance sequence similar to that set forth in Primary Heat Mode 800. In this respect, controller 40 compares the output of sensor 50 against the ideal operating flow value stored in memory for Secondary Heat Mode 900. If the sensed value is lower than the ideal operating flow value, the speed of inducer motor 36 is increased to increase the pressure differential across heat exchanger assembly 18. If the output value of sensor 50 is higher than the ideal operating flow value stored in memory for Secondary Heat Mode 900, the speed of inducer motor 36 is decreased to decrease the pressure differential across heat exchanger assembly 18. In each sequence, controller 40 monitors flame detect sensor 27 to detect whether a flame exists and monitors thermostat 11 to determine whether a secondary heat demand still exists. If no flame is detected by flame detect sensor 27 or no secondary heat request exists from thermostat 11, controller 40 shuts off fuel to the burners 24, 25 and returns the system to Idle/Purge Mode 400. If a flame is detected by flame detect sensor 27 and a secondary heat demand is present from thermostat 11, controller 40 initiates the monitoring and maintenance sequence to maintain the speed of inducer motor 36 at a level where the output value from sensor 50 meets the ideal operating flow value stored within memory for Secondary Heat Mode 900. In this respect, controller 40 maintains the desired ideal operating flow through the heat exchanger assembly 18 during Secondary Heat Mode 900 until a demand for heat no longer exists.

INDUCER MOTOR SPEED COMPENSATION

As set forth above, an ideal operating flow value is established in memory of controller 40 for each of the system's operating modes. These operating flow values establish an optimum pressure drop across heat exchanger assembly 18 for the specific operating conditions required in the given operating mode. In each of the operating modes, controller 40 monitors the output signal of sensor 50 and compares the value of that signal to an ideal operating flow value stored in memory for that specific operating mode, and then adjusts the speed of inducer motor 36 in response thereto.

According to the present invention, the speed of inducer motor 36 is preferably adjusted in steps based upon the size of the deviation noted between actual operating value sensed by sensor 50 and the ideal operating flow value stored in memory. In this respect, it is preferable that a plurality of ranges or bands of operating deviations be established relative to the ideal operating flow value, and that "deviations" (i.e., differences between the sensed output values of sensor 50 and the ideal operating flow value stored in memory) which fall within a specific band result in a compensation of speed relating thereto. In other words, the greater the deviation between the output sensed by sensor 50 and the ideal operating flow value set forth in memory, the greater the acceleration or deceleration of inducer motor 36.

More specifically, each band would represent a range of "deviations" above and below the ideal operating flow value for the specific operating mode. Compensation of the speed of inducer motor 36 (i.e., acceleration or deceleration) would be based upon the band in which the actual deviation computed by controller 40 would fall. In this respect, the greater the deviation between the actual sensed operating value and the ideal operating flow value, the greater the acceleration or deceleration of inducer motor 36. As will be appreciated, acceleration or deceleration of inducer motor 36 causes a change in the pressure differential detected by sensor 50. As the deviation between the actual sensed operating value and the established ideal operating flow value decreases, and enters a band closer to the ideal operating flow value, the acceleration or deceleration rate of inducer motor 36 would decrease. In this respect, as the actual operating flow value of the system approaches the ideal operating flow value, the change in the acceleration or deceleration of inducer motor 36 decreases to reduce the rate of change of the pressure differential. Thus, when the actual operating flow is near the ideal operating flow, only minor changes in the speed of inducer motor will occur to avoid repeated "overshoot" and "undershoot" of the ideal operating flow.

ANTICIPATION SUBROUTINE

According to another aspect of the present invention, controller 40 is preferably programmed to include a safety monitoring routine, and anticipation subroutine wherein controller 40 would store in memory a theoretical or empirically determined range of operating data relating to the operation of a specific component. More specifically, in the system described heretofore, a theoretical or empirically determined range of operating speeds of inducer motor 36 can be established based upon a desired pressure drop across the heat exchanger assembly. The theoretical or empirically determined range of data would represent extreme operating conditions which might be expected during the operation of furnace 10 at the desired pressure drop.

In this respect, by knowing the specific shape and configuration of heat exchanger assembly 18, the demands on inducer motor 36 and inducer blower 34 can be determined for a specific pressure drop across heat exchanger assembly 18. Such data can be empirically or theoretically determined and equated to a range of motor speeds which can be stored in memory. In this respect, for the ideal operating flow value stored in memory for each of the above-identified operating modes, a normal window band or zone of motor operating speeds, can be determined and stored in memory. Inducer motor speeds which fall outside this window or range of motor speeds would be an indication that a problem exists within the system.

For example, a restriction or blockage of air to air inlet 32 would reduce available air to flow through heat exchanger assembly 18. This unusual condition would create an unusual speed demand upon inducer motor 36. Controller 40 would vary the speed of inducer motor 36 to adjust the pressure drop across heat exchanger assembly 18 to the ideal operating flow value stored in memory for the operating mode the system is in. In this situation, instructions to inducer motor 36 would continue until the ideal operating flow value is established. With an anticipation subroutine as described above, controller 40 would detect when the speed of inducer motor 36 is outside the normal operating range or zone stored in memory. This would indicate that a problem exists within the system in that inducer motor 36 is operating at a speed which would not be encountered by the system under normal conditions. When such conditions exist, controller 40 can take a corrective action, such as: 1) shutting down the system, 2) providing a warning signal, either visual or audio, to the operator of the system, 3) limiting operation of inducer motor 36 to a specific speed range or 4) a combination of the foregoing.

ALTERNATE EMBODIMENT

Figure 22:
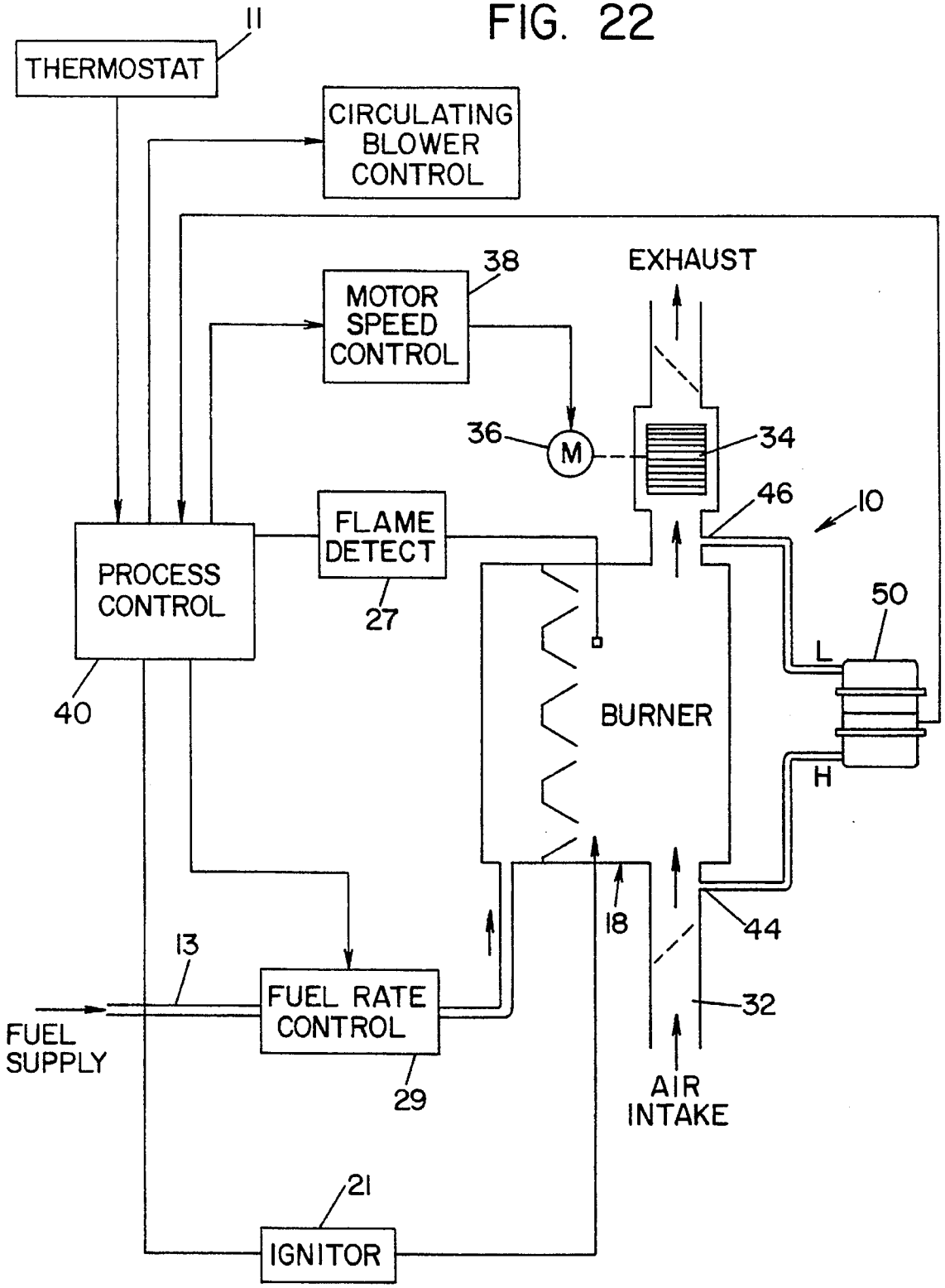
FIG. 22 is a schematic representation of a furnace control system illustrating another embodiment of the present invention.

Referring now to FIG. 22, an alternate embodiment of a furnace control system is shown. In this embodiment, a variable flow fuel regulator 29 is provided in place of pilot valve 15, primary valve 17 and secondary valve 19. Regulator 29 preferably has a flow meter or a sensing element (such as described above) to provide data and feedback to controller 40 as to the actual flow therethrough. Such regulator 29 would typically include a controllable valve element (not shown) to regulate the flow therethrough. Accordingly, controller 40 can control the flow of fuel through regulator 29 in response to sensed flow therethrough to ensure a desired flow rate is established.

In the context of the system shown, controller 40 can establish an optimum gas flow rate through regulator 29 based upon the demand for heat set by thermostat 11. Once the desired fuel flow rate through regulator 29 is established, controller 40 can likewise establish the proper flow rate through the heat exchanger assembly 18 corresponding to such a gas flow rate. Accordingly, by utilizing a sensor 50 according to the present invention, controller 40 can simultaneously monitor and adjust fuel flow rate as well as combustion air flow rate through furnace 10.

CIRCULATING AIR BLOWER

In the system heretofore described, flow requirements through heat exchanger assembly 18 were established by inducer motor 36. In similar respects, circulating air blower 22 may be controlled independently of, or together with, inducer motor 36 by means of controller 40 in response to sensed flow across heat exchanger assembly 18, as schematically illustrated in FIG. 22.

Heretofore, circulating blowers in conventional furnaces generally operated at one of two speeds, a low speed for low burner fire conditions and a high speed for high burner fire conditions. Because the flow of circulating air across heat exchanger assembly 18 affects the heat exchange rate, which in turn affects the pressure drop across heat exchanger assembly, the respective speeds of inducer motor 36 and circulating air blower 22 affect the thermodynamic operating characteristic of heat exchanger assembly 18. Accordingly, with sensor 50 and controller 40 as described above, it is possible to utilize the aforementioned variable speed technology with circulating air blower 22 and to set the operating speed of circulating air blower 22 at a speed setting (obtained through testing or empirically determined) for a desired heat demand and to adjust the speed of inducer blower motor 36 in response to the output of sensor 50 at that given circulating blower speed. In this respect, controller 40 may be programmed to optimize heat transfer to the circulating air for any given heat demand.

Figure 23:
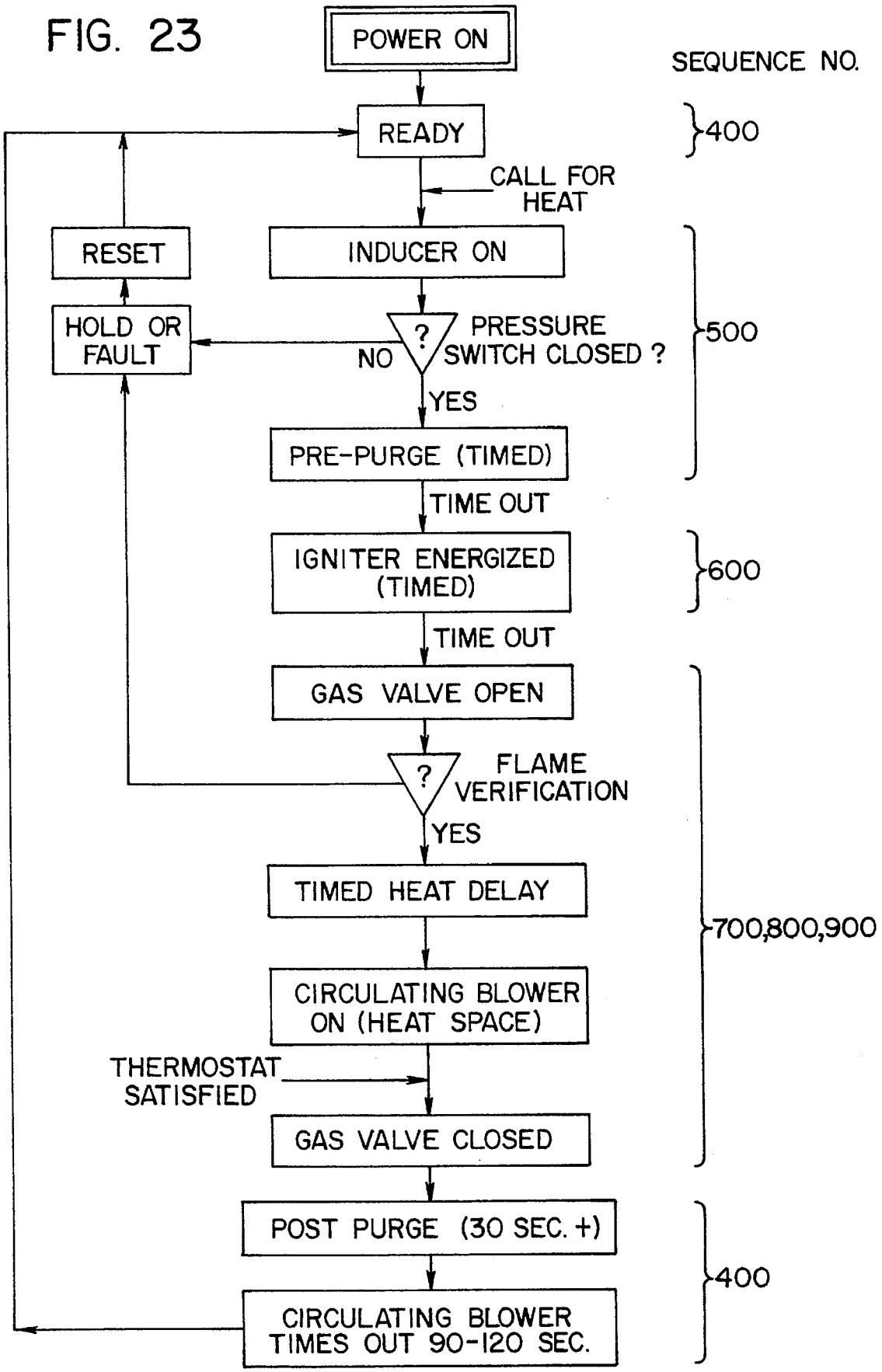
FIG. 23 is a flow diagram showing aspects of the present invention incorporated as part of an overall furnace control system.

FIG. 23 is a flow diagram showing a control system as heretofore described as part of an overall furnace control system. As seen in FIG. 23 the present invention may be easily incorporated as part of a typical furnace control system for optimizing furnace efficiency through control of inducer motor 36, regulator 16 (i.e., valves 15, 17, 19) and circulating air blower 22.

The invention has been described with respect to preferred embodiments, modifications of which will occur to others upon their reading and understanding of the specification. For example, sensor 50 as described above discloses a device for detecting the pressure differential between two negative pressure sources, i.e. a negative/negative sensor. As will be appreciated a sensor of the type disclosed finds advantageous application for detecting pressure differentials between two positive pressure sources, and with minor modifications can detect pressure differentials between a positive pressure source and a negative pressure source. It is intended that all such modifications and alterations be included insofar as they come within the scope of the patent as claimed or the equivalents thereof.

Having thus described the invention, the following is claimed:

1. A differential pressure transducer comprising:

a central housing section, a first cap and a second cap, said caps fastened to said housing section to define a generally cylindrical housing, a pair of generally identical pressure responsive members, each including a rigid circular diaphragm plate having a centrally located pin which extends to one side of said plate along the axis thereof, and an annular diaphragm element of resilient material molded to the outer edge of said diaphragm plate, said diaphragm element including a seal portion formed along the outer periphery thereof, said pressure responsive members being mounted within said housing wherein said pins on said diaphragm plate are coaxially aligned and extend toward each other, the first of said pressure responsive elements being disposed between said central housing section and said first cap with said seal portion thereon forming a first chamber between said first pressure responsive member and said first cap, and the second of said pressure responsive members being disposed between said central housing section and said second cap with said seal portion thereon forming a second chamber between said second pressure responsive member and said second cap, a first inlet port communicating with said first chamber and a second inlet port communicating with said second chamber, said first and second inlet ports adapted for connection respectively to pressure sources to be monitored, a spoiler element mounted to said pins of said pressure responsive members for movement therewith, resonant circuit means including coils surrounding said spoiler element, oscillator means operative to cause resonance of said circuit means and means operative upon connection of said circuit means to an electrical power source to provide an electrical signal indicative of the change in position of said pressure responsive members.

2. A transducer as defined in claim 1 wherein said first and second caps are fastened to said central housing section by crimping.

3. A transducer as defined in claim 1 further comprising a spacer means disposed between said first cap and said central housing and between said second cap and said central housing for limiting compression of said seal means.

4. A transducer as defined in claim 1 further comprising a converter circuit for converting an analog signal to a digital signal.

5. A transducer as defined in claim 1 further comprising a converter circuit for converting a digital signal to an analog signal.

6. A transducer as defined in claim 1 including means for varying the slope of an electrical signal.

7. A transducer as defined in claim 1 including means for providing a square root value of an electrical output signal.

8. A transducer as defined in claim 1 including display means for displaying an electrical output signal in engineering units.

9. A transducer as defined in claim 1 including means for providing an offset to an electrical output signal at zero pressure differential.

10. A differential pressure sensor comprised of:

a housing having first and second spaced apart fluid chamber connectable respectively to first and second fluid pressure sources to be monitored, a pressure responsive assembly within said housing comprised of first and second pressure sensitive members connected to one another, said first pressure sensitive member being exposed to said first fluid chamber and said second pressure sensitive member being exposed to said second chamber, said pressure responsive assembly mounted to said housing wherein said assembly is moveable along a fixed axis in response to differences in fluid pressure in said first and said second chambers, an element attached to said pressure responsive assembly for movement therewith, said element disposed between said first and said second pressure sensitive elements and external to said first and said second chambers, and a non-contacting sensor mounted to said housing adjacent to said element, said sensor being responsive to movement of said element and providing a series of pulses having a frequency indicative of the position of said element.

11. A differential pressure sensor as defined in claim 10 wherein said element is a metallic element and wherein said non-contacting sensor is comprised of a resonant circuit means including coils surrounding said metallic element, oscillator means operative to cause resonance of said circuit means and means operative upon connection of said circuit means to an electrical power source to provide the series of pulses having a frequency indicative of the position of said element.

12. A sensor as defined in claim 11 wherein said pressure responsive assembly is comprised of two pressure responsive members, each of said pressure responsive members including an annular diaphragm element formed of resilient material having a molded outer edge for mounting to said housing.

13. A sensor as defined in claim 12 wherein said pressure responsive assembly engages said housing only along the outer edges of said diaphragm elements.

14. A differential pressure sensor comprised of:

a housing having first and second spaced apart fluid chambers connectable respectively to first and second fluid pressure sources to be monitored, said housing comprised of a plurality of housing sections which are crimped together, a pressure responsive assembly within said housing comprised of first and second pressure sensitive members connected to one another, said first pressure sensitive member begin exposed to said first fluid chamber and said second pressure sensitive member being exposed to said second chamber, said pressure responsive assembly mounted to said housing wherein said assembly is movable along a fixed axis in response to differences in fluid pressure in said first and said second chambers, an element attached to said pressure responsive assembly for movement therewithin, said element disposed between said first and said second pressure sensitive elements and external to said first and said second chambers, and a non-contacting sensor mounted to said housing adjacent to said element, said sensor being responsive to movement to said element and providing electrical signals indication of the position of said element.

15. In a combustion heating system having a heat exchanger, a variable speed inducer motor for creating flow along a path including said heat exchanger, and a transducer for measuring a pressure differential along said path, a method of operating said system comprising the steps of:

establishing a plurality of system operating modes, each of said system operating modes having a predetermined optimum pressure differential value;

sensing a measured pressure differential across the heat exchanger;

providing a first and second series of pulses having a first frequency and second frequency respectively, said first and second frequencies related to the measured pressure differential;

determining a first and second time to count the same number of pulses of each first and second series of pulses respectively;

converting said first and second time into an indication of the measured pressure differential;

computing a deviation between the indication of measured pressure differential and the predetermined optimum pressure differential value; and varying the velocity of the variable speed inducer motor in accordance with said deviation.

16. The invention of claim 15 further comprising primary burner assembly and a pilot burner; and wherein said plurality of operating modes includes a pre-purge mode for evacuating fluid from said path after a request for heat has been initiated, an ignition mode for lighting said pilot burner, and a primary ignition mode for igniting said primary burner assembly of the heating apparatus, said pre-purge mode, said ignition mode and said primary ignition mode, each having a different optimum pressure differential value.

17. The invention of claim 15, wherein the velocity of the variable speed inducer motor is varied in steps.

18. The invention of claim 17, wherein the size of said steps vary in accordance with the relative value of the deviation.

19. The invention of claim 15, wherein the velocity of the variable speed inducer motor is varied by adjusting the velocity until a predetermined deviation is obtained.

20. The invention of claim 16, wherein the predetermined pressure differential value for said pre-purge mode is lower than the predetermined pressure differential value for said primary ignition mode.

21. A controller for regulating a combustion flow rate along a path in a combustion system having a heat exchanger and a variable speed inducer motor, said controller comprising:

means for establishing a plurality of operating modes;

means for storing a predetermined optimum pressure differential value for each said operating mode;

sensing means for sensing a measured pressure differential between two locations along said path and for providing a series of pulses having a frequency related to the measured pressure differential;

means for determining a time to count a predetermined number of said pulses and for converting said time into an indication of the measured pressure differential;

calculation means for calculating a deviation between the indication of measured pressure differential and the predetermined optimum pressure differential value; and means for varying the velocity of the variable speed inducer motor in accordance with the deviation.

22. A heating apparatus as defined in claim 21 wherein said variable speed inducer motor is an SR motor.

23. A heating apparatus including:

a combustion air inlet, a combustion means for receiving a flow of combustion air and for burning a mixture of combustion air and combustible fluid to produce a combusted fluid air mixture, a heat exchanger means defining a path for a flow of combusted fluid air mixture therethrough, a motor-driven means for creating a flow of the combustion air through said combustion means and for providing a flow of the combusted fluid air mixture along said path through said heat exchanger means, a differential pressure transducer means for determining a difference in pressure between two positions along said path and for providing a series of pulses having a frequency related to said difference in pressure;

a microprocessor control system comprising:

means for converting the series of pulses into an indication of the difference in pressure;

means for storing at least one predetermined pressure differential value;

means for determining a deviation between the indication of difference in pressure and the at least one predetermined pressure differential value; and means operatively connected to said variable motor-driven means for adjusting the difference in pressure between the two positions along said heat exchanger in accordance with said deviation.

24. A heating apparatus as defined in claim 23 wherein said motor-driven means for creating a flow of the combustion air is driven by a SR motor.

25. A heating apparatus as defined in claim 23, wherein said means for adjusting controls the motor-driven means to adjust the flow of the combustion air, flow of combustible fluid air mixture and flow of combustion byproducts.

26. A control system for monitoring and adjusting a pressure differential value across a fluid flow chamber, said control system comprising:

differential sensor means for sensing a first measured pressure at a first location along the fluid flow chamber and a second measured pressure at a second location along the fluid flow chamber, and providing a series of pulses having a frequency related to the pressure differential value;

means for determining a time to count a predetermined number of said series of pulses and for converting said time into an indication of the measured pressure differential value;

calculation means for calculating a deviation between the indication of measured pressure differential value and a predetermined pressure differential value; and means for changing the pressure differential value in accordance with said deviation.

27. A control system as defined in claim 26, wherein said means for changing changes the speed of a blower means.

28. A control system as defined in claim 27, wherein said blower means is driven by a SR motor.

29. A controller for regulating a combusted fluid flow rate in a combustion system having a heat exchanger, a variable speed inducer motor, a variable gas flow regulator, said controller comprising:

means for storing a gas pressure differential value and a corresponding air pressure differential value, for a plurality of heat demand values;

first sensing means for sensing a first measured pressure differential across the heat exchanger and for providing series of pulses having a frequency related to the first measured pressure differential, means for determining a time to count a predetermined number of said series of pulses and for converting said time into a indication of the first measured pressure differential;

second sensing means for sensing a second measured pressure differential across the variable gas flow regulator and for providing a second signal output that is related thereto;

calculation means for calculating a first deviation between the indication of first measured pressure differential and the stored air pressure differential value and a second deviation between the second signal output and the stored gas pressure differential value; and means for changing the combustion flow rate in accordance with said first and second deviations.

30. A controller as defined in claim 29, wherein said means for changing the combustion flow rate changes the speed of the variable speed inducer motor.

31. A controller as defined in claim 29, wherein said means for changing the combustion flow rate changes the flow of fluid through said fluid flow regulator.

32. A controller for regulating a flow rate of a heat transfer fluid for maximum efficiency, said controller comprising;

means for storing a first flow rate parameter and a corresponding second flow rate parameter, for a plurality of heat transfer parameters;

first sensing means for indicating a first flow rate along a first path and for providing a series of pulses having a frequency related to said first flow rate;

processor means for counting a predetermined number of said series of pulses and for determining an interval of time required to count the same, said processor means converting said interval of time into an indication of the first flow rate;

second sensing means for indicating a second flow rate along a second path and for providing a signal output related thereto, said processor means determining from said signal output an indication of the second flow rate comparison means for comparing said indication of first flow rate to said stored first flow rate parameter and for comparing said indication of second flow rate to said stored second flow rate parameter for a particular heat transfer parameter; and means for changing the flow rate of the heat transfer fluid in response to said comparison.

33. A controller for regulating a flow rate of a heat transfer fluid in a heat transfer system, said heat transfer system having a heat transfer fluid flow path, means for creating flow along said path, an air flow path, air flow regulator, a fuel flow path, and a fuel flow regulator, said controller comprising:

means for storing a predetermined fuel pressure differential and a corresponding predetermined heat transfer fluid pressure differential, for a plurality of heat demand values, first sensing means adapted to measure fuel pressure differential along the fuel flow path at said fuel source and for providing a first output signal indicative thereof;

second sensing means for sensing a measured heat transfer fluid pressure differential along the heat transfer fluid flow path and for providing a series of pulses having a frequency related thereto;

means for converting the first output into an indication of the fuel pressure differential and for converting the series of pulses into an indication of the heat transfer fluid pressure differential;

comparison means for comparing said predetermined fuel pressure differential to said indication of fuel pressure differential and for comparing said predetermined heat transfer fluid pressure differential to said indication of heat transfer fluid pressure differential; and means for regulating said air flow regulator and said fuel flow regulator in response to said comparison means.

34. A controller as defined by claim 33, wherein said plurality of heat transfer values correspond respectively to a plurality of operating modes.

35. A controller as defined by claim 34, wherein said plurality of operating modes includes a purge mode and a primary heat mode.

36. A controller as defined in claim 33, wherein said first sensing means and said second sensing means are each comprised of a dual diaphragm transducer.

37. A control system for regulating the flow rate of a heat transfer fluid in a heat transfer system, said heat transfer system having a heat transfer fluid flow path, flow control means for creating flow along said path, a fuel source for providing a combustible fuel to said path, an air source for providing combustion air to said path, and means for combusting said fuel and air to create said heat transfer fluid, said control system comprising:

means for storing a fuel flow value and a corresponding air flow value for a plurality of heat transfer values;

first sensing means for sensing a measured flow value at said fuel source and providing a first signal output related thereto;

second sensing means for sensing a measured flow value at said air source and providing a series of pulses having a frequency related thereto;

means for determining a time to count a predetermined number of pulses and for converting said time into an indication of the flow value at said air source, said determining means converting said first signal output into an indication of the flow value at said fuel source;

comparison means for comparing said stored fuel flow value to said indication of flow value at said fuel source, and for comparing said stored air flow value to said indication of flow value at said air source;

fuel regulating means for regulating said fuel flow at said fuel source; and means for adjusting said fuel regulating means and said flow control means in response to said comparison means.

38. A control system as defined in claim 37 wherein said fuel regulating means is a variable flow regulator.

39. A control system as defined in claim 38 wherein said first sensing means is a differential pressure sensor sensing pressure across said regulator.

40. A control system as defined in claim 37 wherein said second sensing means senses a pressure differential along said heat transfer fluid flow path.

41. A control system as defined in claim 37 wherein said second sensing means is a dual diaphragm transducer.

42. A control system as defined in claim 37 wherein said first and second sensing means are continuous output sensing devices.

43. A control system for regulating the flow rate of a heat transfer fluid in a heat transfer system, said heat transfer system having a heat transfer fluid flow path, flow control means for creating flow along said path, a fuel source for providing a combustible fuel to said path, an air source for providing combustion air to said path, and means for combusting said fuel and air to create said heat transfer fluid, said control system comprising:

sensing means for sensing a measured flow value at said air source and for producing a series of pulses having a frequency related to said sensed flow value;

means for determining an interval of time to count a predetermined number of pulses from said series of pulses and for converting said interval of time into an indication of the measured flow value;

means for storing an optimum flow value at said air source;

means for storing a range of operating control values for said flow control means, said operating control values corresponding to said optimum flow value;

calculation means for calculating a deviation between said indication of measured flow value and said optimum flow value; and means for varying the operation of said flow control means in accordance with said deviation.

44. A control system as defined in claim 43 wherein said sensing means is a differential pressure transducer and measures a pressure differential between two locations along said heat transfer fluid flow path.

45. A control system as defined in claim 44 wherein said heat transfer system is a gas furnace having a heat exchanger defining said heat transfer fluid flow path.

46. A control system as defined in claim 43 wherein said heat transfer system includes a plurality of operating modes, each of said modes having an optimum flow value and a corresponding range of operating control values.

47. A control system as defined in claim 43 wherein said flow control means is an inducer blower and said operating control values relate to the speed of said inducer blower.

48. A control system as defined in claim 47 wherein said inducer blower is driven by an SR motor.

49. A control system as defined in claim 43, wherein said means for varying the operation of said flow control means includes means for terminating operation of said heat transfer system.

50. A control system as defined in claim 43, wherein said means for varying the operation of said flow control means includes alarm means for indicating that said flow control means is operating outside said range of operating control values.

51. A control system as defined in claim 43, wherein said means for varying the operation of said flow control means includes means for limiting operation of said flow control means to said range of operating control values.

52. A heating apparatus including:

a combustion air inlet, a combustion means for receiving a flow of combustion air and for burning a mixture of combustion air and combustible fluid to produce a combusted fluid air mixture, a heat exchanger means defining a path for a flow of combusted fluid air mixture therethrough, a flow device for creating a flow of the combustion air through said combustion means and for providing a flow of the combusted fluid air mixture along said path through said heat exchanger means, an SR motor for driving said flow device, a differential pressure transducer for determining a pressure value at two positions along said path and providing a series of pulses having a frequency related to the pressure values, a microprocessor control system for controlling said SR motor, said control system determining a time to count a predetermined number of said series of pulses and for converting said time into an indication of the measured pressure differential, said control system monitoring any deviation between the indication of the measured pressure differential value provided by the continuous differential pressure transducer means and a predetermined pressure differential value, and adjusting the speed of said SR motor in response thereto.

* * * * *